US008132988B2

(12) United States Patent
Dawson et al.

(10) Patent No.: US 8,132,988 B2
(45) Date of Patent: Mar. 13, 2012

(54) RETAINING WALL BLOCK

(75) Inventors: William B. Dawson, Medina, MN (US); Robert A. MacDonald, Plymouth, MN (US)

(73) Assignee: Keystone Retaining Wall Systems, Inc., Bloomington, MN (US)

( * ) Notice: Subject to any disclaimer, the term of this patent is extended or adjusted under 35 U.S.C. 154(b) by 0 days.

(21) Appl. No.: 12/839,028

(22) Filed: Jul. 19, 2010

(65) Prior Publication Data

US 2010/0281809 A1 Nov. 11, 2010

Related U.S. Application Data

(63) Continuation of application No. 10/754,454, filed on Jan. 9, 2004, now Pat. No. 7,780,141, which is a continuation-in-part of application No. 29/186,712, filed on Jul. 21, 2003, now Pat. No. Des. 501,935.

(51) Int. Cl.
*E02D 29/02* (2006.01)
*E02D 5/00* (2006.01)
*E04C 1/00* (2006.01)

(52) U.S. Cl. ..... 405/286; 52/604; 52/606; 52/608

(58) Field of Classification Search ..... 52/608, 52/609, 574, 604, 610, 611, 606; 405/284, 405/286

See application file for complete search history.

(56) References Cited

U.S. PATENT DOCUMENTS 751,346 A 2/1904 Schall
760,803 A 5/1904 Oosting
799,709 A 9/1905 Bradley et al.
819,229 A 5/1906 Johnson
895,614 A * 8/1908 Benson ..... 249/104
955,230 A * 4/1910 Van Caeyseele ..... 52/503
1,045,411 A 11/1912 Kenny
1,219,127 A 3/1917 Marshall
1,355,580 A * 10/1920 Tyson ..... 52/505
1,526,730 A 2/1925 Zottoll
1,631,901 A 6/1927 Threadgill
1,647,436 A 11/1927 Covey
1,652,180 A 12/1927 Nicholas
1,690,462 A 11/1928 Smith (Continued)

FOREIGN PATENT DOCUMENTS

CH 628 382 A5 2/1982

(Continued)

OTHER PUBLICATIONS

English Language Abstract for CH 628 382 A5, published Feb. 26, 1982 (1 page).

(Continued)

*Primary Examiner* — Michael Safavi

(74) *Attorney, Agent, or Firm* — Popovich, Wiles & O'Connell, P.A.

(57) ABSTRACT

A method of making a wall block and a mold box therefore. The wall block design maximizes the use of the mold box. The method produces wall blocks having a large surface area front face compared to the front face size of prior art blocks. The blocks have about one third more front surface area. This results in faster construction of walls and a faster construction sequence. The method of making the blocks makes efficient use of mold space and material, resulting in higher production yields and/or higher total daily production square footage.

6 Claims, 27 Drawing Sheets

U.S. PATENT DOCUMENTS

| | | | | |
|---|---|---|---|---|
| 2,121,450 | A | | 6/1938 | Sentrop |
| 2,324,039 | A | * | 7/1943 | Stone ..... 52/604 |
| 3,017,683 | A | | 1/1962 | Huch et al. |
| 3,694,128 | A | | 9/1972 | Foxen |
| 4,023,767 | A | | 5/1977 | Fontana |
| 4,063,866 | A | | 12/1977 | Lurbiecki |
| 4,098,865 | A | | 7/1978 | Repasky |
| 4,218,206 | A | | 8/1980 | Mullins |
| 4,335,549 | A | | 6/1982 | Dean, Jr. |
| 4,426,176 | A | | 1/1984 | Terada |
| 4,592,678 | A | | 6/1986 | McNich, Jr. et al. |
| 4,684,294 | A | | 8/1987 | O'Neill |
| 4,698,949 | A | | 10/1987 | Dietrich |
| 4,704,832 | A | * | 11/1987 | Vassiliadis ..... 52/279 |
| D296,365 | S | | 6/1988 | Forsberg |
| 4,802,320 | A | | 2/1989 | Forsberg |
| 4,802,836 | A | | 2/1989 | Whissell |
| 4,884,921 | A | | 12/1989 | Smith |
| 4,909,717 | A | | 3/1990 | Pardo |
| 5,062,610 | A | | 11/1991 | Woolford et al. |
| 5,108,281 | A | | 4/1992 | Pardo |
| 5,135,384 | A | | 8/1992 | Redwine |
| 5,163,261 | A | | 11/1992 | O'Neill |
| RE34,314 | E | | 7/1993 | Forsberg |
| 5,281,125 | A | | 1/1994 | Gebhardt |
| 5,484,236 | A | | 1/1996 | Gravier |
| 5,551,809 | A | | 9/1996 | Forsberg |
| 5,598,679 | A | | 2/1997 | Orton et al. |
| 5,865,005 | A | | 2/1999 | Cataldo |
| 5,930,964 | A | | 8/1999 | Boechning |
| 6,106,264 | A | | 8/2000 | Stenekes |
| 6,113,379 | A | | 9/2000 | LaCroix et al. |
| 6,322,742 | B1 | | 11/2001 | Bott |
| 6,557,818 | B2 | | 5/2003 | Manthei |
| 6,615,561 | B2 | | 9/2003 | MacDonald et al. |
| 6,773,642 | B1 | | 8/2004 | Wardell |
| 6,829,867 | B2 | | 12/2004 | Gresser et al. |
| D501,935 | S | | 2/2005 | Dawson et al. |
| 6,854,702 | B2 | | 2/2005 | Manthei et al. |
| 6,978,580 | B1 | | 12/2005 | Clark et al. |
| 7,048,250 | B2 | | 5/2006 | Mothes |
| 7,090,439 | B1 | | 8/2006 | Carey et al. |
| 7,140,867 | B2 | | 11/2006 | Scherer et al. |
| 7,156,645 | B2 | | 1/2007 | Ness |
| 7,175,414 | B2 | | 2/2007 | Ness et al. |
| 7,179,077 | B2 | | 2/2007 | Channells |
| 7,261,548 | B2 | | 8/2007 | Ness |
| 7,278,845 | B2 | | 10/2007 | Krause et al. |
| 2003/0126821 | A1 | | 7/2003 | Scherer et al. |
| 2003/0182011 | A1 | | 9/2003 | Scherer |
| 2003/0214069 | A1 | | 11/2003 | Suto et al. |
| 2004/0028484 | A1 | | 2/2004 | Woolford |
| 2005/0016106 | A1 | | 1/2005 | Dawson et al. |

FOREIGN PATENT DOCUMENTS

| | | | |
|---|---|---|---|
| FR | 2 506 367 | A | 11/1982 |
| SU | 939214 | A1 | 6/1982 |
| WO | WO 00/22243 | A1 | 4/2000 |
| WO | WO 02/101157 | A2 | 12/2002 |

OTHER PUBLICATIONS

English Language Abstract for FR 2 506 367 A, published Nov. 26, 1982 (1 page).

Nov. 30, 2004 Notification of Transmittal of the International Search Report and the Written Opinion of the International Searching Authority, or the Declaration in International Application No. PCT/US2004/023256 (13 pages).

Translation of Jun. 19, 2008 Office Action in corresponding Russian Patent Application No. 2006105197 (6 pages).

* cited by examiner

RETAINING WALL BLOCK

This application is a divisional of pending prior application Ser. No. 10/754,454, filed Jan. 9, 2004, which is a continuation-in-part of Application Ser. No. 29/186,712, filed Jul. 21, 2003, now U.S. Pat. No. D501,935 S, issued Feb. 15, 2005, the contents of each of which are hereby incorporated herein by reference.

FIELD OF THE INVENTION

The present invention relates to retaining wall blocks and a method for making these blocks.

BACKGROUND OF THE INVENTION

Numerous methods and materials exist for the construction of retaining walls. Such methods include the use of natural stone, poured in place concrete, masonry, and landscape timbers or railroad ties. In recent years, segmental concrete retaining wall units which are dry stacked (i.e., built without the use of mortar) have become a widely accepted product for the construction of retaining walls. Such products have gained popularity because they are mass produced, and thus relatively inexpensive. They are structurally sound, easy and relatively inexpensive to install, and couple the durability of concrete with the attractiveness of various architectural finishes.

It is desirable to build a wall from such blocks quickly and without the need for special skilled labor. The efficiency of building a wall can be measured by determining how fast the front face of a wall is constructed. Clearly, this depends on the size of the blocks used and ease of stacking the blocks.

It is standard practice in the prior art to use similarly sized mold boxes to produce various styles of block. For example, a standard size box has a block molding area of about 18 inches by about 24 inches (about 45.7 cm by about 61 cm), and produces a block about 8 inches (20.3 cm) thick. FIG. 1A illustrates retaining wall block B1 in mold box M. This block is symmetrical about a centrally located vertical plane of symmetry. Block B1 has pin holes PH, pin receiving cavities PC, and two cores C1 and C2. The sides generally converge from the front to the back of the block. Front face F is produced by the removal of waste portion W after the block has formed. This portion is split off to form a roughened surface. The block of FIG. 1A is manufactured one block at a time so that the yield per cycle is one square foot (1 sq ft or 929 sq cm) of front face. A typical weight for this block is about 110 lbs (50 kg).

Other prior art blocks are shown in FIGS. 1B and 1C in mold box M. This block is similar to that described in WO 02/101157 (MacDonald et al.). This block also has similarities to block B1, as it is symmetrical about a centrally located vertical plane of symmetry. Block B2 has pin holes PH, pin receiving cavities PC, and core C. Preferably, the blocks are formed so that front face F will have a roughened appearance. Block B2 is made in a mold box two at one time. This provides a good use of mold space, producing about two square feet (1858 sq cm) of front face per manufacturing cycle. FIG. 1B illustrates that the blocks can be formed two at a time and separated at the back faces. In this case, the front surface of the block is textured by texturing elements T that contact the front surface as the block is removed from the mold box. FIG. 1C shows blocks that are molded together at front face F. The front faces of these blocks will be separated, or split apart after curing. The splitting of such blocks is used to form the desirable surface appearance. When manufactured in this manner, each block has a front face of about one square foot (1 sq ft or 929 sq cm). Thus, the yield per cycle is two square feet of front face. A typical weight for this block is about 85 lbs (38.6 kg).

A third type of prior art block in its mold box M is shown in FIG. 1D. Block B3 is a rectangular block, shown having two cores or cavities C. The long dimension of the block typically is used to form the face of a wall. Thus, this type of block produces a useful front surface about 24 inches long, rather than the 18 inch long surface of blocks B1 and B2. The surface area (for the same thickness block, i.e., about 8 inches) is about 33% greater than the surface area of blocks B1 or B2. However, this block weighs about 250 lbs (113.6 kg) and must be set in place using mechanized means.

Accordingly, a need in the art remains for wall blocks that make the most use of a mold box's area while producing a block with a large front surface area.

SUMMARY OF THE INVENTION

The present invention is a mold box and a method of making a wall block that maximizes the use of the mold box and produces wall blocks having a large surface area front face that are lightweight and easy to handle when constructing a wall. This results in faster construction of walls and a faster construction sequence, because for each block, the front face surface area is larger than blocks known in the art. The method of making the blocks makes efficient use of mold space and material, resulting in higher production yields and/or higher total daily production square footage.

In one aspect, this invention is a mold box for making first and second wall blocks comprising first and second opposed end rails and first and second opposed side rails, the end rails and side rails together forming a mold cavity, the first and second end rails being spaced apart a distance d1, the first and second side rails being spaced apart a distance d2 which is less than distance d1; and a divider plate having a first end connected to the first end rail and a second end connected to the second end rail, the divider plate dividing the mold cavity into a first mold section for forming the first block and a second mold section for forming the second block.

In another aspect, this invention is a mold box for making first and second wall blocks comprising first and second opposed end rails and first and second opposed side rails, the end rails and side rails together forming a mold cavity, the first and second end rails being spaced apart a distance d1, the first and second side rails being spaced apart a distance d2 which is less than distance d1; and a divider plate having a first end connected to the first end rail and a second end connected to the second end rail, the divider plate dividing the mold cavity into a first mold section for forming the first block and a second mold section for forming the second block, the first mold section being configured such that a front face of the first block is formed adjacent the first side rail, the second mold section being configured such that a front face of the second block is formed adjacent the second side rail.

In another aspect, this invention is a mold box for making first and second wall blocks comprising first and second opposed end rails and first and second opposed side rails, the end rails and side rails together forming a mold cavity, the first and second end rails being spaced apart a distance d1, the first and second side rails being spaced apart a distance d2 which is less than distance d1; and a divider plate having a first end connected to the first end rail and a second end connected to the second end rail, the divider plate dividing the mold cavity into a first mold section for forming the first block and a second mold section for forming the second block, the first mold section being configured such that a front face of the first block is formed adjacent the first side rail, the second mold section being configured such that a front face of the second block is formed adjacent the second side rail, the divider plate being shaped in a non-planar configuration such that a maximum first block depth measured between the first side rail and the divider plate along a line generally perpendicular to the first side rail is greater than d2/2 and a maximum second block depth measured between the second side rail and the divider plate along a line generally perpendicular to the second side rail is greater than d2/2.

In another aspect, this invention is a method of making wall blocks comprising providing a mold box having first and second opposed end rails and first and second opposed side rails, the end rails and side rails together forming a mold cavity, the first and second end rails being spaced apart a distance d1, the first and second side rails being spaced apart a distance d2 which is less than distance d1; dividing the mold cavity into a first mold section for forming a first block and a second mold section for forming a second block, the first mold section being configured such that a front face of the first block is formed adjacent the first side rail, the second mold section being configured such that a front face of the second block is formed adjacent the second side rail; filling the first and second mold sections with a desired block material; and removing the block material from the first mold section to form the first block and from the second mold section to form the second block, the first block having a maximum depth measured between the front face and a rear face along a line generally perpendicular to the front face which is greater than d2/2 and the second block having a maximum depth measured between the front face and a rear face along a line generally perpendicular to the front face which is greater than d2/2.

In another aspect, this invention is a method of making wall blocks comprising providing a mold box having first and second opposed end rails and first and second opposed side rails, the end rails and side rails together forming a mold cavity, the first and second end rails being spaced apart a distance d1, the first and second side rails being spaced apart a distance d2 which is less than distance d1; dividing the mold cavity into a first mold section for forming a first block and a second mold section for forming a second block, the first mold section being configured such that a front face of the first block is formed adjacent the first side rail, the second mold section being configured such that a front face of the second block is formed adjacent the second side rail; filling the first and second mold sections with a desired block material; and removing the block material from the first mold section to form the first block and from the second mold section to form the second block, the front faces of the first and second blocks each having a length approximately equal to d1.

In another aspect, this invention is a method of making wall blocks comprising providing a mold box having first and second opposed end rails and first and second opposed side rails, the end rails and side rails together forming a mold cavity, the first and second end rails being spaced apart a distance d1, the first and second side rails being spaced apart a distance d2 which is less than distance d1; connecting a divider plate between the first and second end rails to divide the mold cavity into a first mold section for forming a first block and a second mold section for forming a second block, the first mold section being configured such that a front face of the first block is formed adjacent the first side rail, the second mold section being configured such that a front face of the second block is formed adjacent the second side rail; filling the first and second mold sections with a desired block material; and removing the block material from the first mold section to form the first block and from the second mold section to form the second block.

In another aspect, this invention is a method of making wall blocks comprising providing a mold box having first and second opposed end rails and first and second opposed side rails, the end rails and side rails together forming a mold cavity, the first and second end rails being spaced apart a distance d1, the first and second side rails being spaced apart a distance d2 which is less than distance d1; connecting a divider plate between the first and second end rails to divide the mold cavity into a first mold section for forming a first block and a second mold section for forming a second block, the first mold section being configured such that a front face of the first block is formed adjacent the first side rail, the second mold section being configured such that a front face of the second block is formed adjacent the second side rail, the divider plate being non-planar and having a first mold surface and a second mold surface, a rear face of the first block being formed adjacent the first mold surface and a rear face of the second block being formed adjacent the second mold surface, the divider plate being configured such that the rear faces of the first and second blocks overlap when they are formed in the mold cavity; filling the first and second mold sections with a desired block material; and removing the block material from the first mold section to form the first block and from the second mold section to form the second block.

In another aspect, this invention is a wall block comprising a front portion including opposed top and bottom surfaces, opposed side surfaces and a front surface, the front surface having a length equal to the distance between the side surfaces and a height equal to the distance between the top and bottom surfaces. The at least one leg extends from the front portion in a direction opposite the front surface and has a rear surface, a distance between the front surface and rear surface comprising a maximum block depth. The at least one leg is positioned such that when a plurality of the blocks including first and second blocks are packaged for shipment the first and second blocks can be positioned on a common surface with their front surfaces oriented in opposite directions with the at least one leg of the first block overlapping the at least one leg of the second block so that the first and second blocks occupy an area on the common surface which is less than the length of the front surface times twice the block depth.

In another aspect, the invention is a wall block comprising a front portion including opposed top and bottom surfaces, opposed side surfaces and a front surface, the front surface having a length equal to the distance between the side surfaces and a height equal to the distance between the top and bottom surfaces. The at least one leg extends from the front portion in a direction opposite the front surface and has a rear surface, the at least one leg being positioned such that when a wall is formed from multiple courses of the blocks which are offset from course to course by about one half the length of the front surface the legs in each course of blocks align vertically.

DETAILED DESCRIPTION OF PREFERRED EMBODIMENTS

Figure 1A:
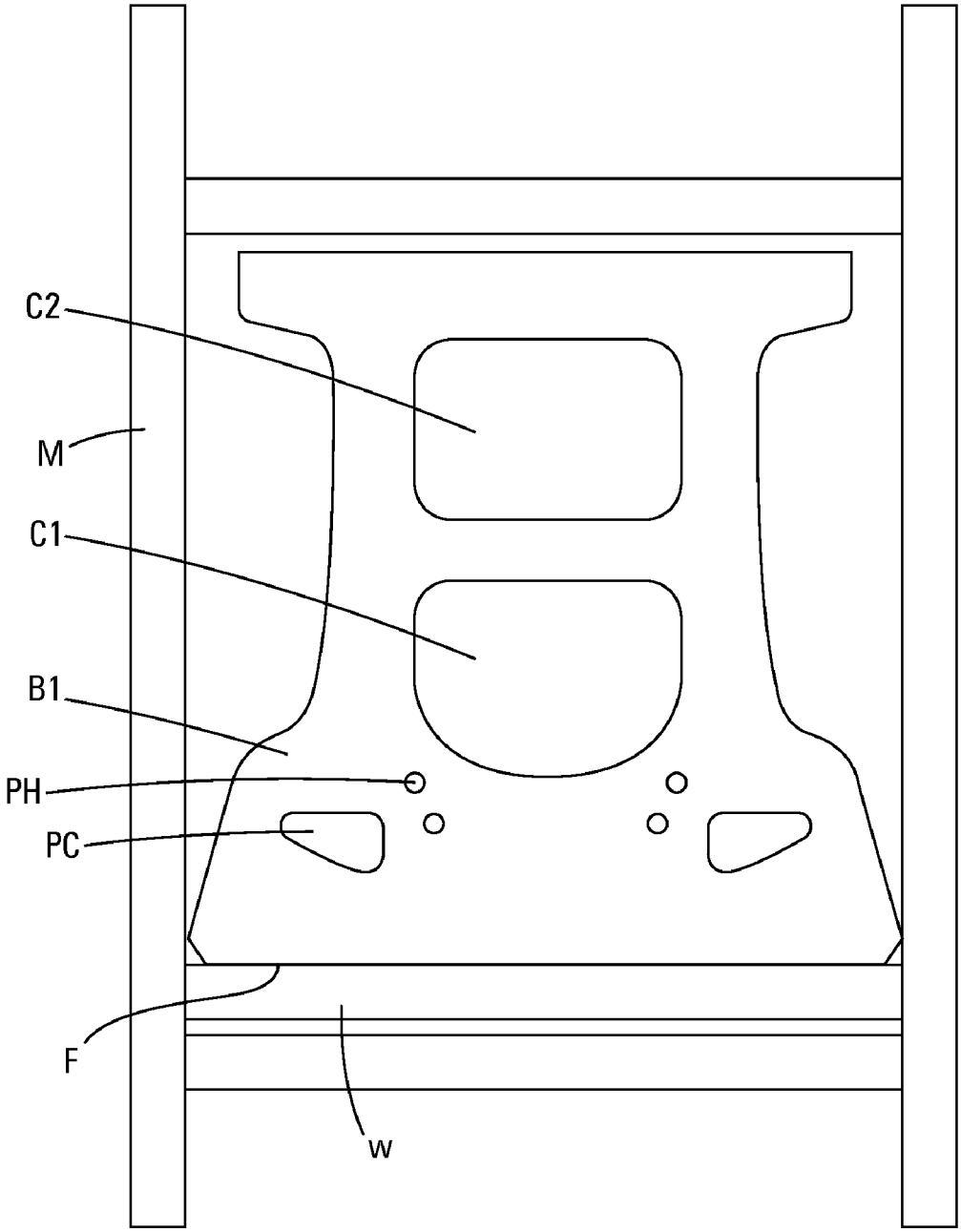
Fig. 1A Prior Art
FIG. 1A is plan view of the mold box configuration for a first Prior Art block.
Figure 1B:
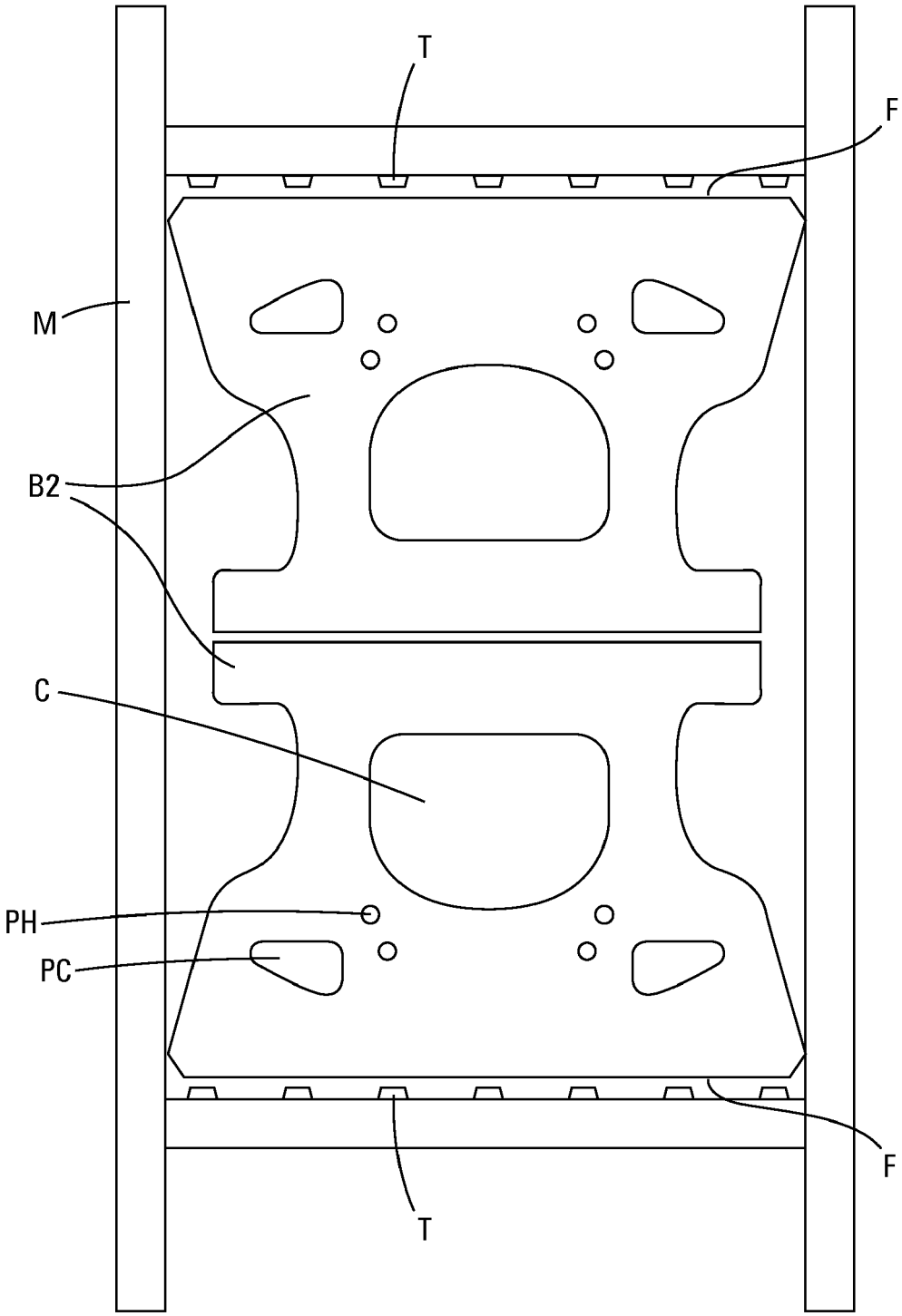
Fig. 1B Prior Art
FIG. 1B is a plan view of a first mold box configuration for a second Prior Art block.
Figure 1C:
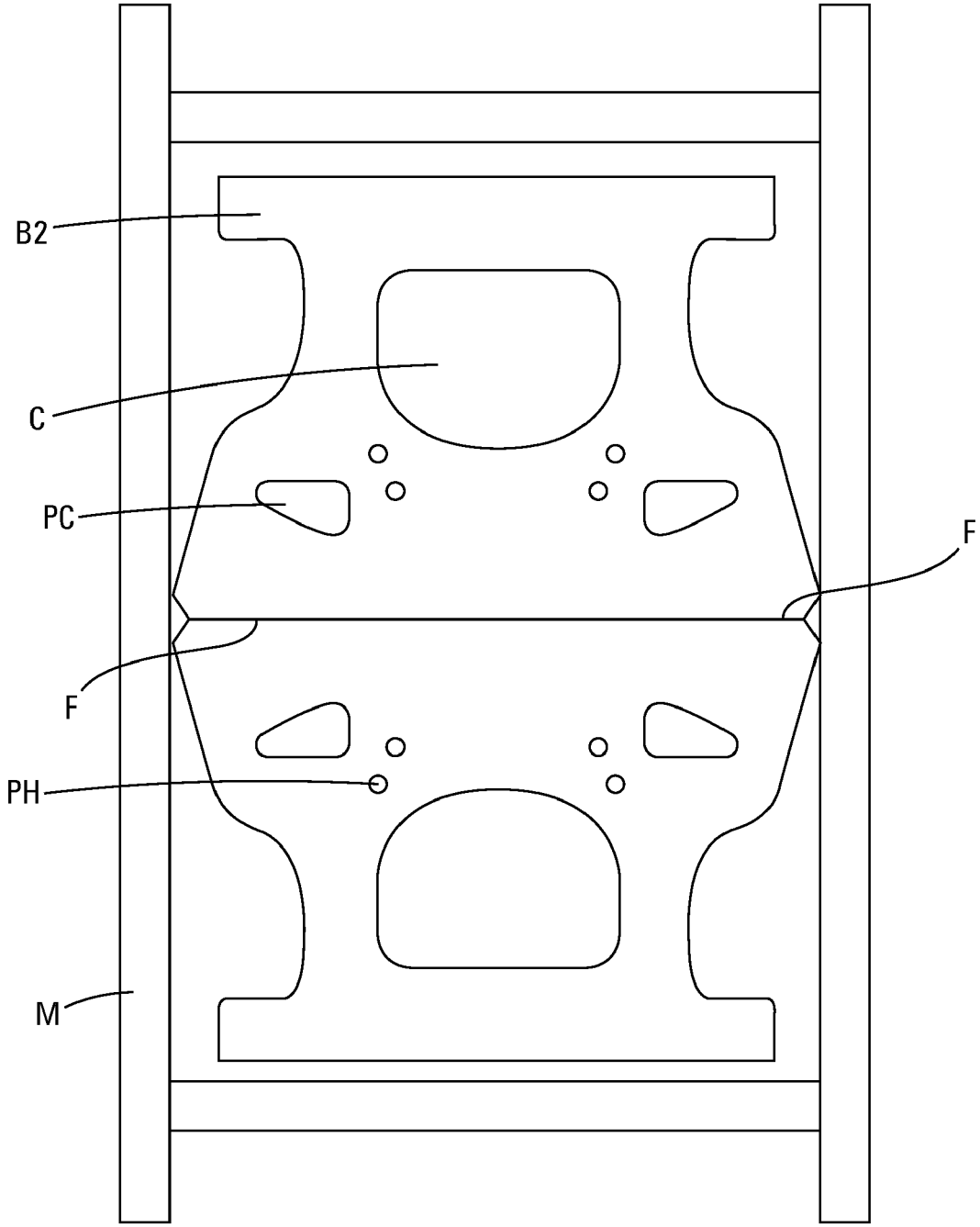
Fig. 1C Prior Art
FIG. 1C is a plan view of a second mold box configuration for a second Prior Art block.
Figure 1D:
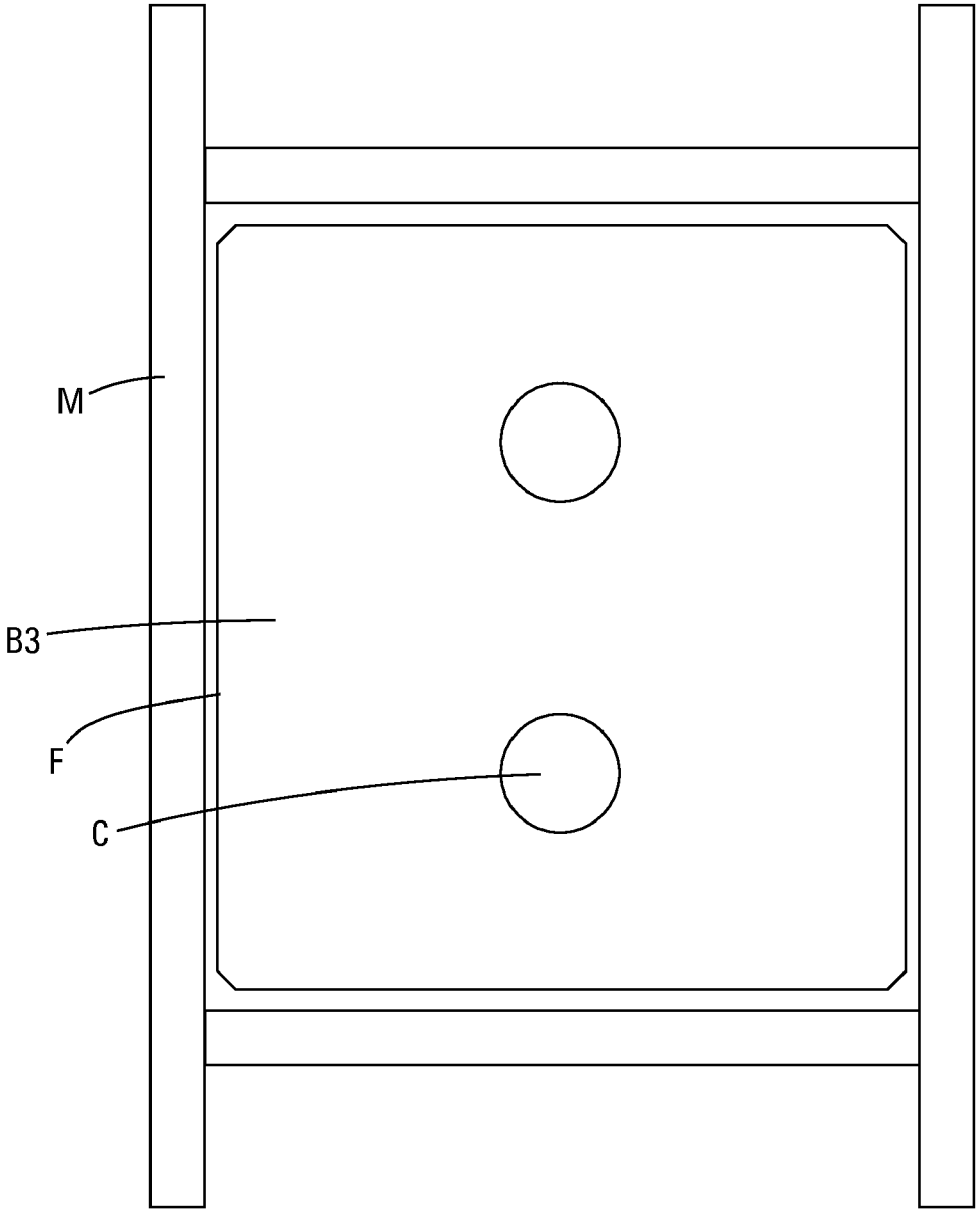
Fig. 1D Prior Art
FIG. 1D is a plan view of a mold box configuration for a third Prior Art block.

In this application, "upper" and "lower" refer to the placement of the block in a retaining wall. The lower surface faces down, that is, it is placed such that it faces the ground. In forming a retaining wall, one row of blocks is laid down, forming a course. A second course is laid on top of this by positioning the lower surface of one block on the upper surface of another block.

The blocks of this invention may be made of a rugged, weather resistant material, such as concrete, especially if the wall is constructed outdoors. Other suitable materials include plastic, reinforced fibers, and any other materials suitable for use in molding wall blocks. The surface of the blocks may be smooth or may have a roughened appearance, such as that of natural stone. The blocks are formed in a mold and various textures can be formed on the surface, as is known in the art.

Several embodiments are illustrated in the figures below. In one embodiment, this invention is a block comprising a front portion having two legs extending therefrom. The two legs each have a core and a back portion and the back face of each back portion is the back of the block. The cores are optional and their positions can be varied. The legs are located asymmetrically on the block. The legs have sides that define the area of the core and the leg side walls generally converge from the front toward the back.

In another embodiment, this invention is a block similar to the block described above, except that one of the legs joins the front portion at right angles. This block is suitable for forming a corner structure.

In another embodiment, this invention is a block having one leg extending from the front face where the leg is located at one side of the front face.

In another embodiment, this invention is a block having multiple curvilinear legs, all legs extending away from the front surface.

The blocks of this invention may be provided with a connection means for connecting blocks in adjacent courses. The connection means may comprise pin holes and pin receiving cavities. The cavities in a second or top block accept the head of a pin placed in a pin hole of a first or bottom block. Alternatively, the bottom surface of this block may be provided with a channel configured to accept the head of a pin placed in a pin hole in an underlying block. The appearance of the front face of the block may be varied as desired.

The advantage to the design of blocks described herein is that the blocks provide good structural stability with a maximum amount of block front face and a minimum use of material. Not only are the blocks easy to handle, but the manufacture of the blocks is efficient in its use of space and material, which can be seen, for example, by the illustration of FIGS. 22A and 22B, discussed further below. The blocks are made by forming matching pairs of blocks in a single mold designed so that one or more legs on a first block interweave or overlap with one or more legs on a second block. In this way the blocks nest together. The length of the front face of the block is generally about twice the distance from the front of the block to the back face of a leg. This has been found to maximize the volume of mold space used. Molding the blocks in this manner is also an advantage when it comes to shipping the blocks since the blocks are removed from the mold, pallatized and shipped in the same overlapping or nested configuration. This overlapping configuration takes up less space and is easier to handle than blocks molded in a conventional manner. The depth of the block (i.e., the distance from front to back surfaces) is greater than half the mold box depth. It should be understood, however, that other lengths or dimensional relationships of the blocks can be used within the scope of the invention.

This block design maximizes the area of the front face of the block while minimizing the weight of the block. As a result, the block manufacturer is able to produce more wall area per manufacturing or mold cycle and gain greater yield of wall blocks per a given volume of raw materials while at the same time manufacturing the blocks in a configuration which saves space and is easy to handle and to ship. The wall installer is able to install more face area of wall each time a block is placed and the blocks generally weigh no more or just slightly more than prior art blocks having a smaller front surface area.

Figure 2:
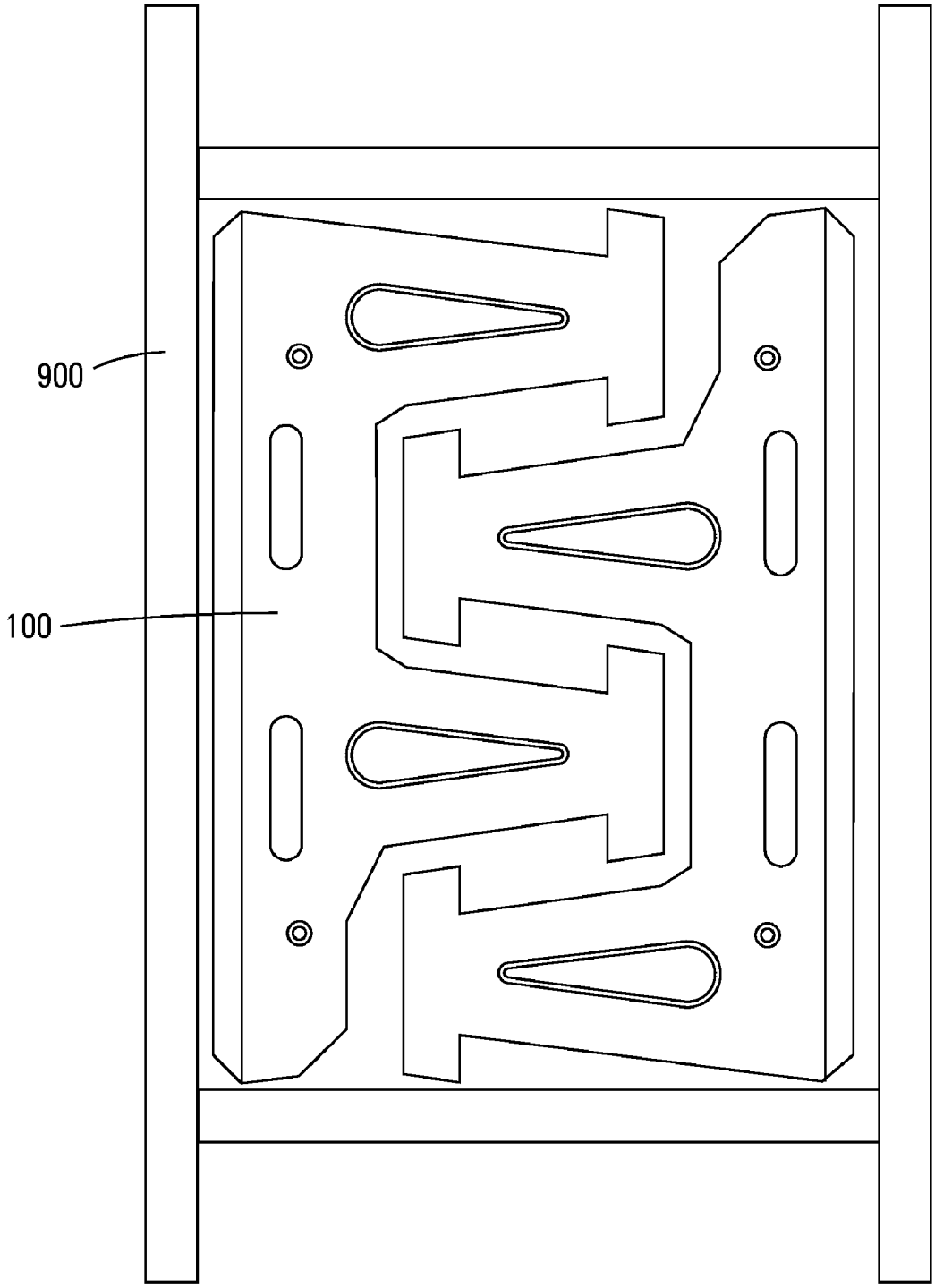
FIG. 2 is a plan view of the configuration of the block of this invention in a mold box.
Figure 3:
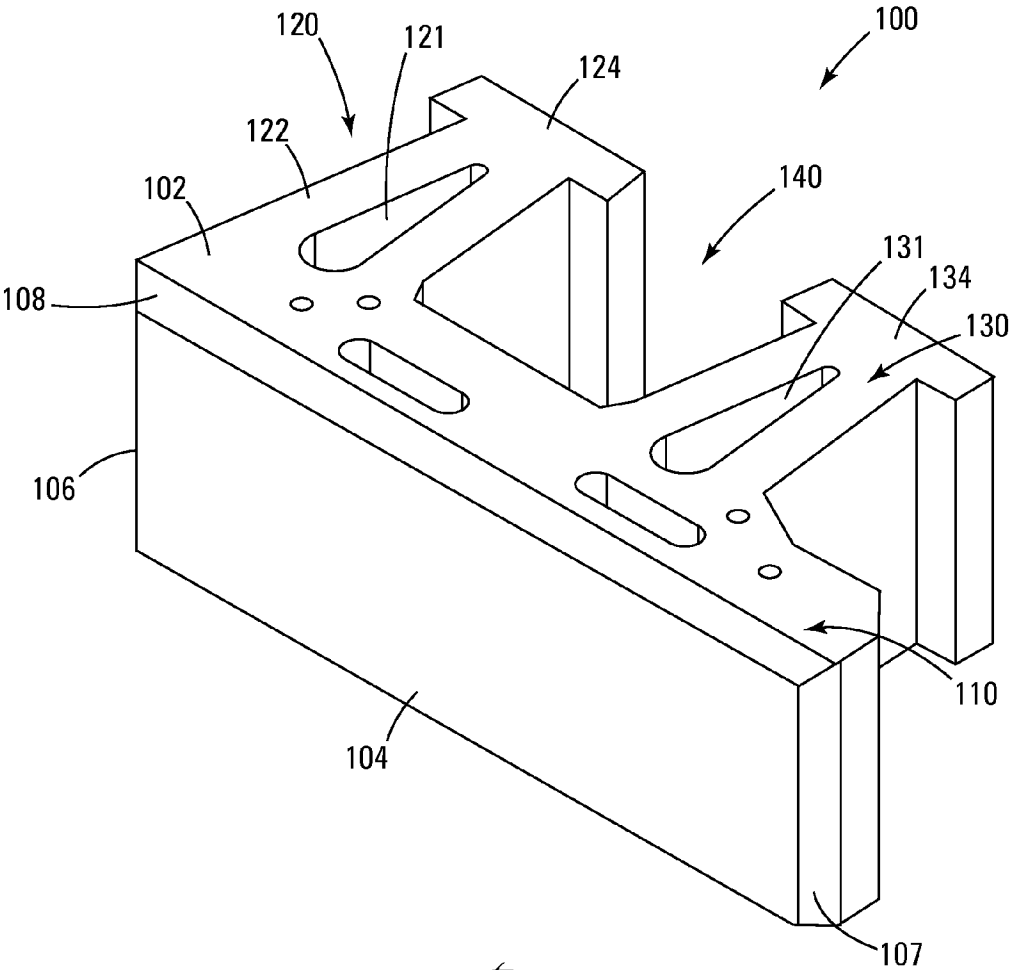
FIG. 3 is a perspective view of the block of this invention.

It is useful to compare the block of the present invention to prior art blocks, such as those illustrated in FIGS. 1A to 1D above. FIG. 2 shows the present inventive blocks 100 in a mold box. This figure can be compared directly with FIGS. 1A to 1D. The mold box illustrated is a standard size for the industry, about 18 by 24 inches, and produces a block about 8 inches thick. Blocks 100 each weigh about 95 lbs (43.2 kg). The front surface (F) of the block is the dimension of the long dimension of the mold box, i.e., about 24 inches. Thus this block has a larger surface area (24 by 8 inches, 192 sq in, or 1.33 sq ft) than the surface area (18 by 8 inches, 144 sq in, or 1 sq ft) of the prior art blocks shown in FIGS. 1A to 1C. This equals a 33% increase in front surface area. Yet the weight increases only about 11%, to 95 lbs from 85 lbs (43.2 to 38.6 kg), still a handleable weight.

In addition, an even greater manufacturing advantage is realized because the inventive blocks are made two at a time. Thus, one production cycle produces 2.66 sq ft (2470 sq cm) of front surface area per manufacturing cycle. This compares to the production of one sq ft for Prior Art block B1, two sq ft for Prior Art block B2, and 1.33 sq ft. for Prior Art block B3. In addition, in all cases for the present block, the capacity of the mold box is maximized or at least increased substantially.

Various embodiments of the blocks of this invention are shown in the drawings.

FIGS. 3 to 7 illustrate block 100. FIGS. 8A and 8B illustrate block 100*a*, which is substantially similar to block 100 except that block 100*a* has rounded corners and fewer pin holes. Similar features of these blocks will be referred to by the same numbers. Block 100 has parallel top face 102 and bottom face 103. Front face 104 has optional bevel or chamfer 108 adjacent the top and sides of the block to provide a desirable appearance. The length of face 104 is defined by the distance between corners 106 and 107. Extending from front portion 110 are two legs 120 and 130. Cores 121 and 131 are located primarily in the legs, though they extend into front portion 110. It should be noted that the shape of the cores as shown in the figures is a convenient shape for manufacturing, however, any suitable shape can be used. Legs 120 and 130 extend to rear portions 124 and 134, respectively, having rear faces 125 and 135, respectively.

Figure 6:
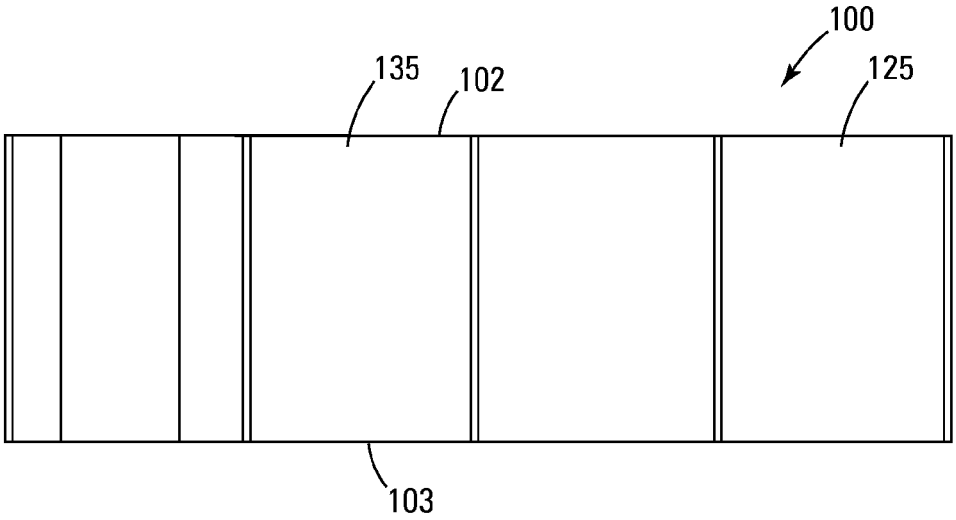
FIG. 6 is a back view of the block of FIG. 2.

Front face 104 and rear faces 125 and 135 each extend from top face 102 to bottom face 103, as shown in FIG. 6. The distance between faces 102 and 103 defines the thickness of the block.

Legs 120 and 130 are separated by void 140. Each leg 120 and 130 has two side walls 122, 123 and 132, 133, respectively. These side walls generally converge from the front to the back of the block. The side walls extend from top face 102 to bottom face 103. In a preferred embodiment, legs 120 and 130 are positioned such that, when stacking blocks one on top of another in a wall, a leg of one block is placed over a leg in an underlying block and a running bond pattern is created. The alignment of legs is desirable because it adds to the structural stability of a wall, and also permits the introduction of vertical reinforcement or filler materials that would extend through the cores and voids of adjacent legs.

Figure 5A:
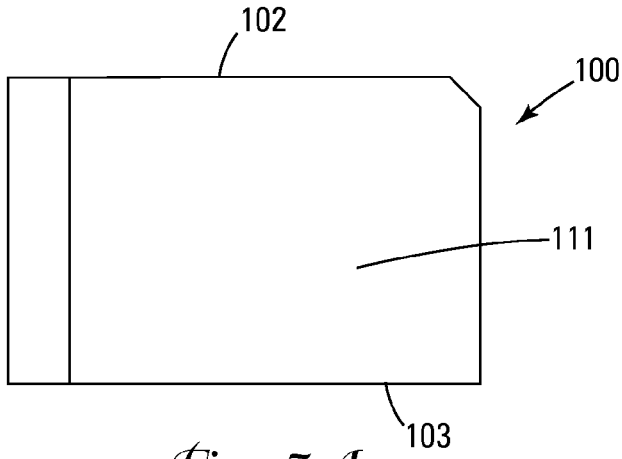
FIGS. 5A and 5B are side views of the block of FIG. 2.
Figure 5B:
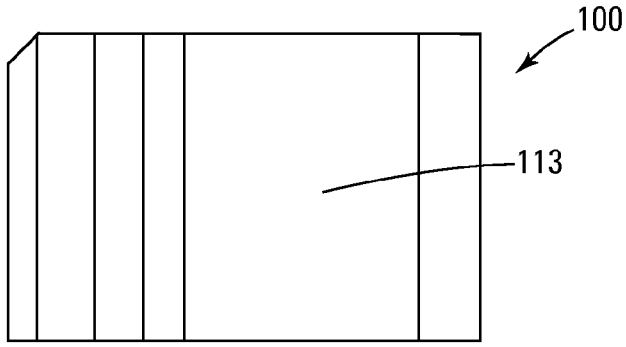

Side 111 of block 100 is shown in FIG. 5A and side 113 is shown in FIG. 5B. Side 111 comprises the side surfaces of leg side wall 122 and back portion 124, and the side of front portion 110. Side 113, as shown in FIG. 5B, comprises the side surfaces of leg side wall 133 and back portion 134, and the side of front portion 110.

Figure 4A:
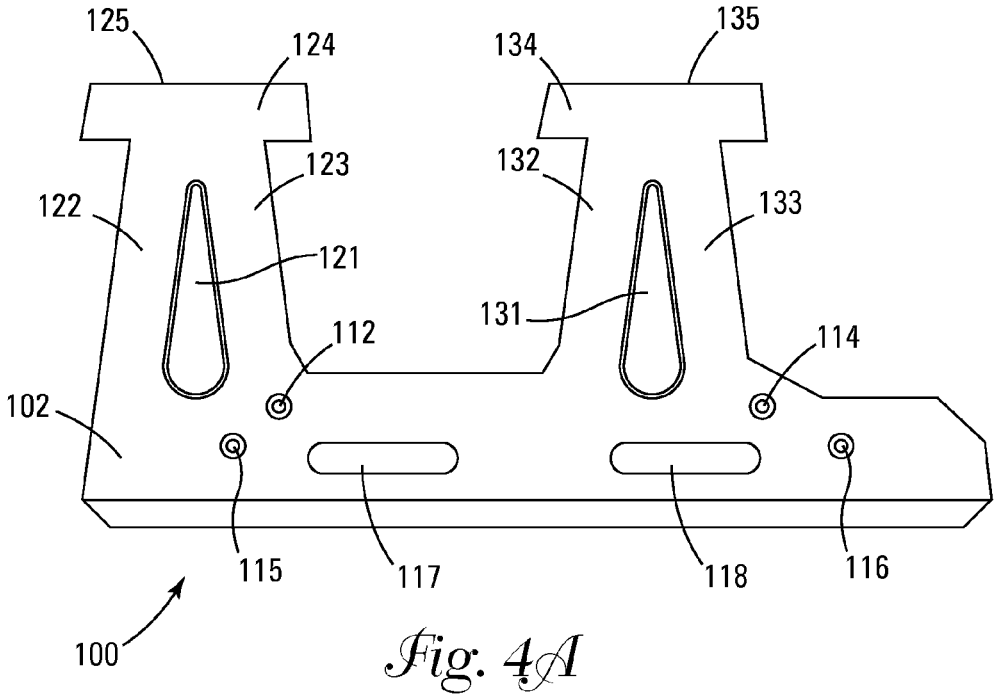
FIG. 4A is a top view and FIG. 4B is a bottom view of the block of FIG. 2.
Figure 4B:
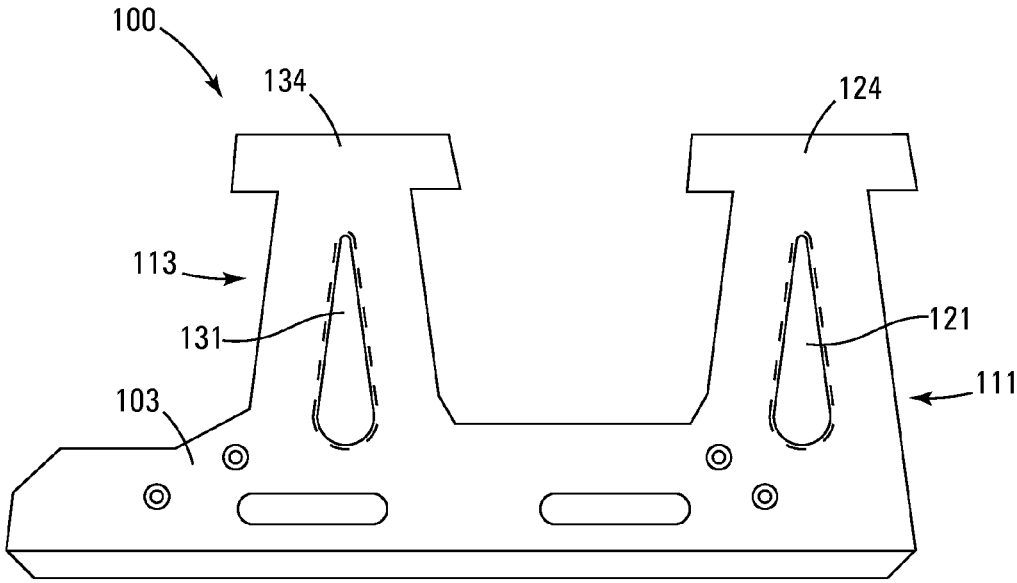

Front portion 110 (FIG. 3) includes front face 104 and also includes pin holes 112, 114, 115, and 116 and pin receiving cavities 117 and 118 (FIG. 4A).

It should be noted that the shape of the cores as shown in FIGS. 3 to 8 is a convenient shape for manufacturing, however, any suitable shape can be used. The cores serve to reduce the weight of the block. When a block is manufactured, a core is tapered from top to bottom to ease stripping the block from the mold, as known to one of skill in the art. Cores are optional but may be desirable since they reduce the amount of material required to make the block, and they allow more blocks to be shipped since weight is usually a constraint on how many blocks may be shipped at one time. In addition, a lower weight block is easier for those who handle the block when constructing a wall. Further, the size and shape of the legs and voids can be varied.

Pin receiving cavities 117 and 118 are positioned at any desired location along the front portion of the block and may have any desired shape. The placement of cavities in conjunction with pin holes 115 and 116 can be used to form a running-bond pattern in a wall of blocks. The pin receiving cavities may extend from the top to the bottom of the block, which aids in minimizing block weight, or may only partially extend toward the bottom of the block. However, they also could be depressions in the block rather than passageways.

Pin holes 112, 114, 115 and 116 extend from the top face 102 to bottom face 103. Four pin holes are shown, but more or fewer pin holes may be used. The holes are tapered to ease the removal of forming elements from the molded block. These pin holes are sized to receive a connecting element, such as a pin. The pin may be a shouldered pin, in which case the pin hole may be substantially the same diameter for the thickness of the block, or the pin holes may be truncated to allow a portion of a headless pin to sit above the surface of the block. Various pins are described further below.

Figure 7:
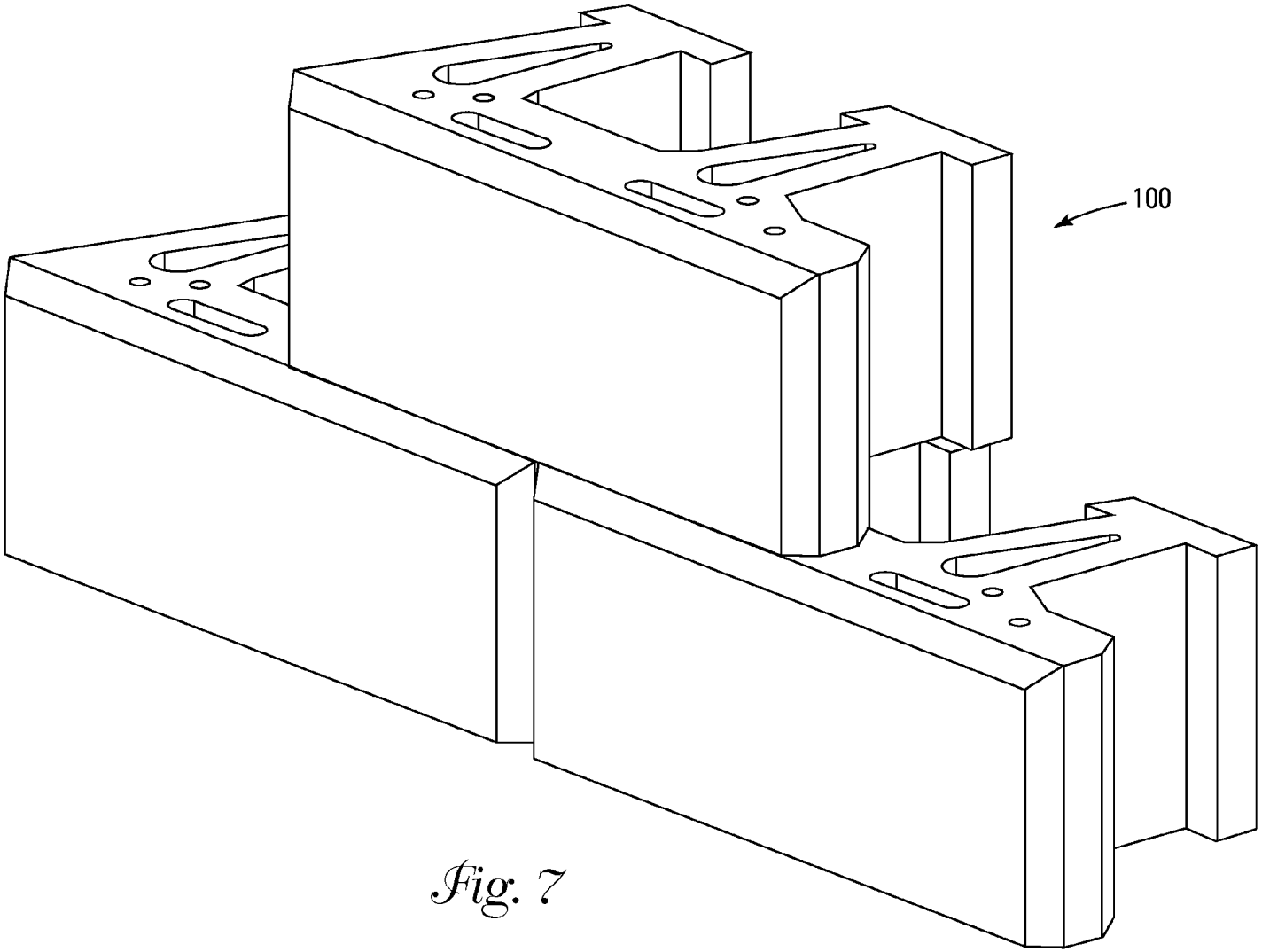
FIG. 7 is a perspective view showing stacked blocks of FIG. 2.
Figure 8A:
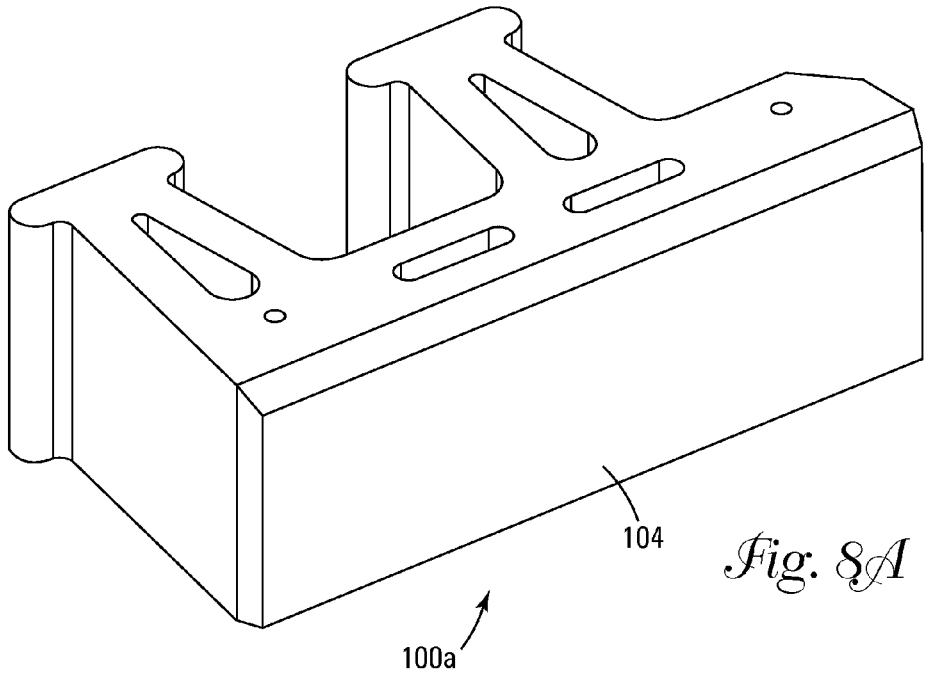
FIG. 8A is a perspective view and FIG. 8B is a top view of another block of this invention.
Figure 8B:
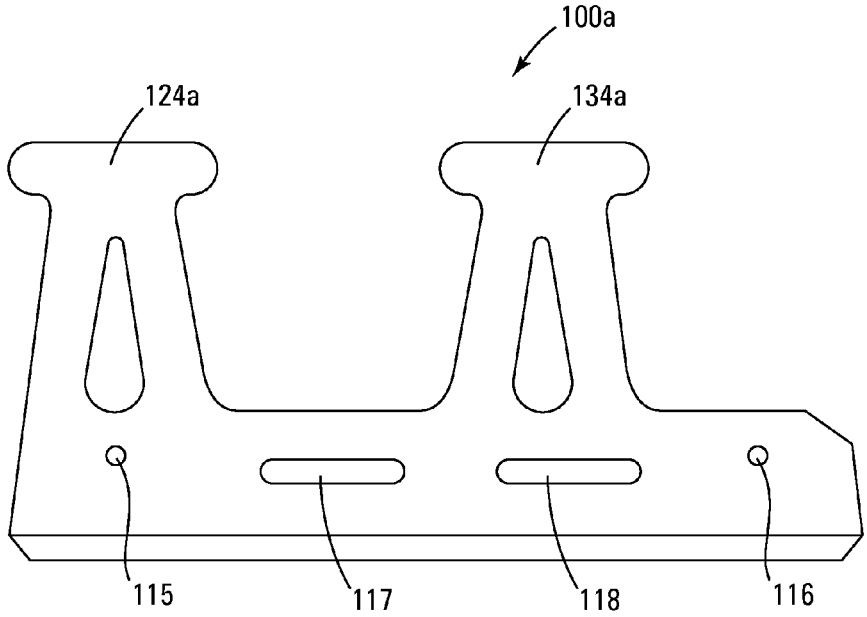

Block 100 is shown stacked in a running bond pattern in FIG. 7. These blocks are configured so that the back portion of a block above rests on at least a part of the back portion of the block below. Optimally, a leg of one block is placed on the leg of an underlying block. This adds stability to a wall formed from these blocks and increases the frictional connection of the blocks.

Block 100*a* in FIGS. 8A and 8B is similar to block 100, having curvilinear back portions 124*a* and 134*a* that extend from legs 120 and 130. Curvilinear shapes frequently are more desirable due to the ease of removal of the block from a mold.

Figure 9:
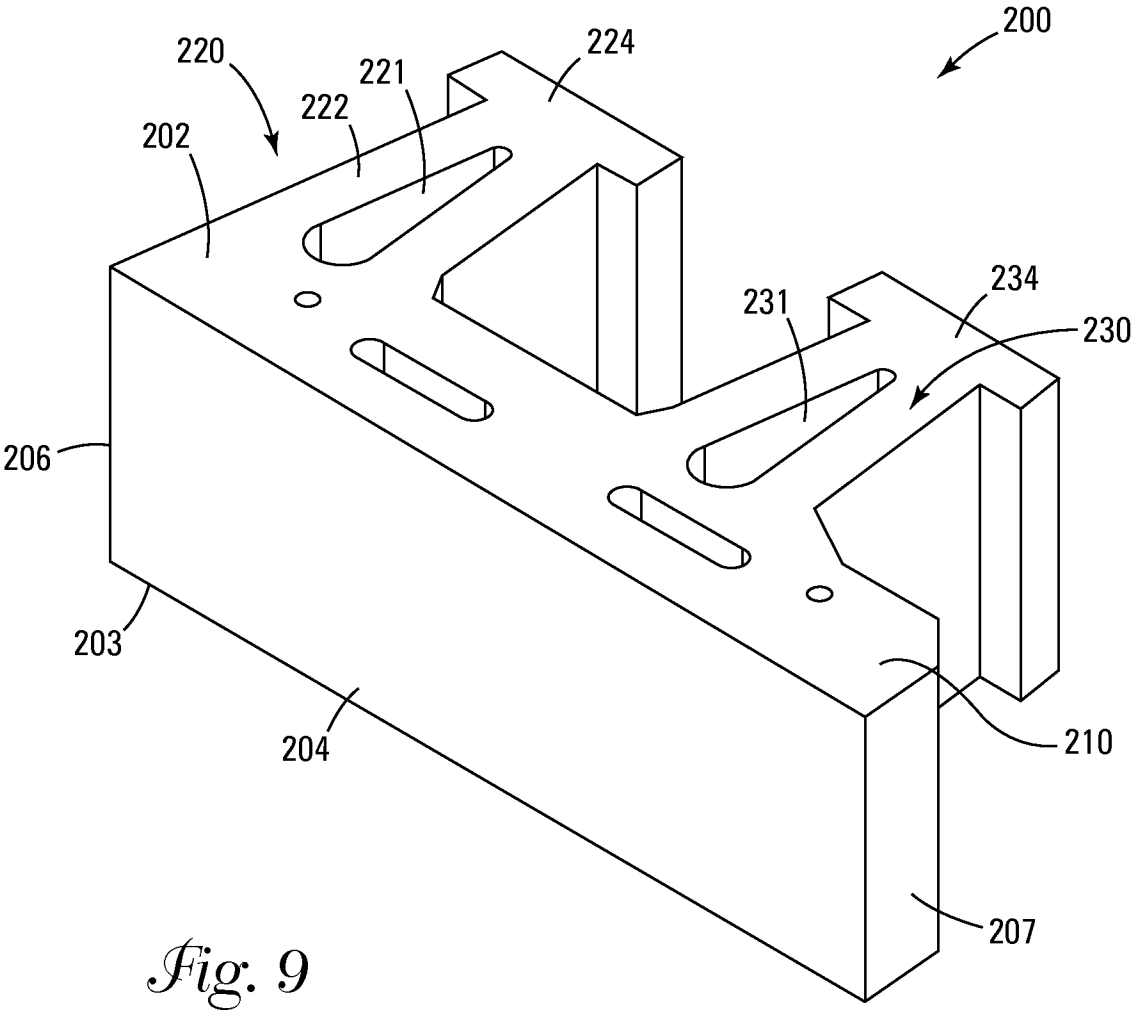
FIG. 9 is a perspective view of another block of this invention.
Figure 10:
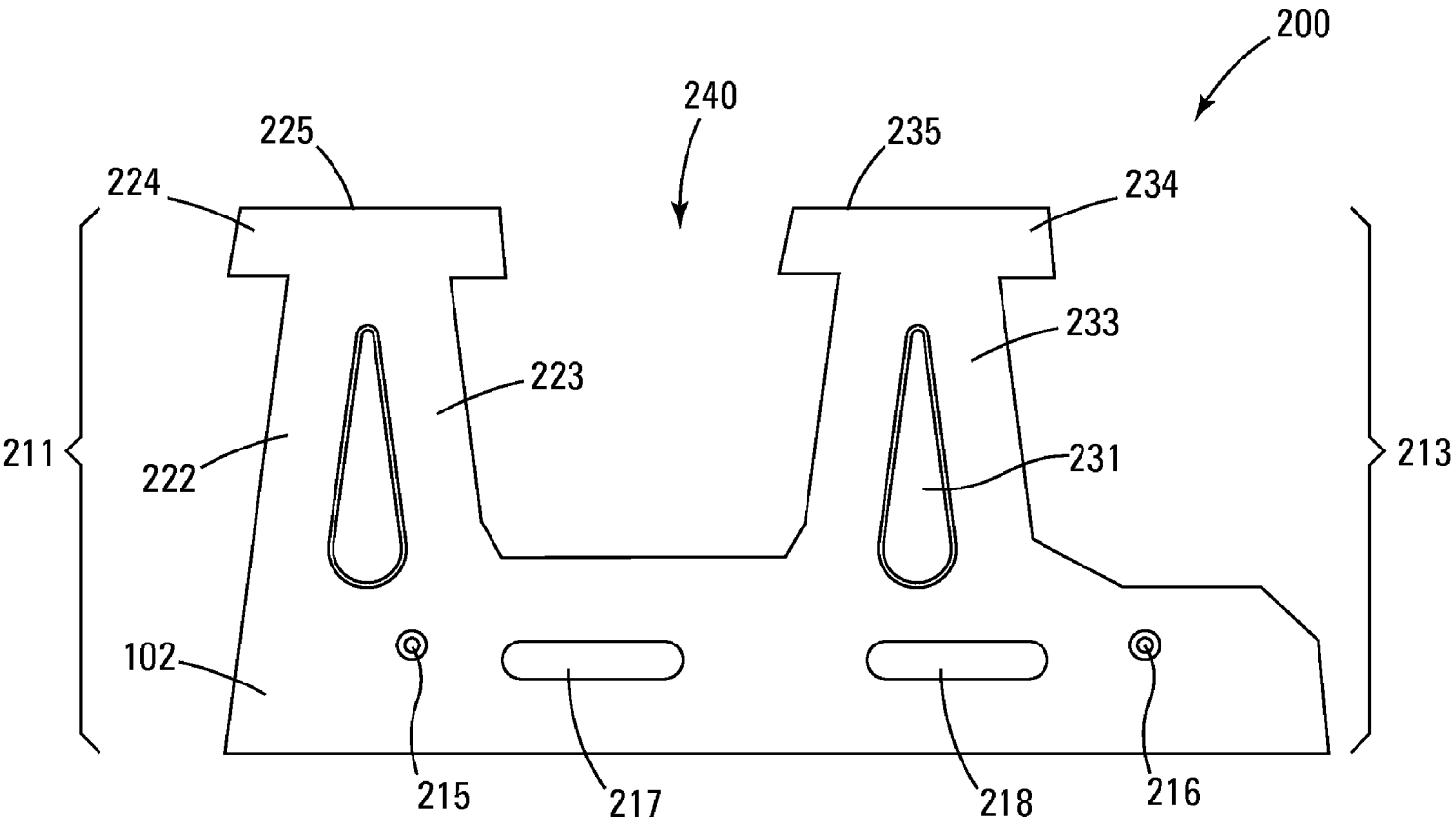
FIG. 10 is a top view of the block of FIG. 9.

FIGS. 9 and 10 illustrate another embodiment of the block. Block 200 is similar to blocks 100 and 100*a* of FIGS. 3 to 8, except that there are no chamfers on the front of the block. The absence of chamfered edges and corners is that the top and the bottom of the block are interchangeable, that is, if block 200 is flipped over, it is a mirror image of another block 200. By contrast, the minor image of block 100 would have to be manufactured separately if it is desired to use the block in more than one orientation when constructing a retaining wall.

FIGS. 9 and 10 show block 200 having parallel top face 202 and bottom face 203. The length of face 204 is defined by the distance between corners 206 and 207. Extending from front portion 210 are two legs 220 and 230. Cores 221 and 231 are located primarily in the legs, though they extend into front portion 210. Legs 220 and 230 extend to rear portions 224 and 234, respectively, having rear faces 225 and 235, respectively. Front face 204 and rear faces 225 and 235 each extend from top face 202 to bottom face 203. The distance between faces 202 and 203 defines the thickness of the block.

Legs 220 and 230 are separated by void 240. Each leg 220 and 230 has two side walls 222, 223 and 232, 233, respectively, generally converging from the front to the back of the block. Block side walls 211 and 213 extend from top face 202 to bottom face 203. Pin holes 215 and 216 and pin receiving cavities 217 and 218 are located on the front portion of the block.

Figure 11:
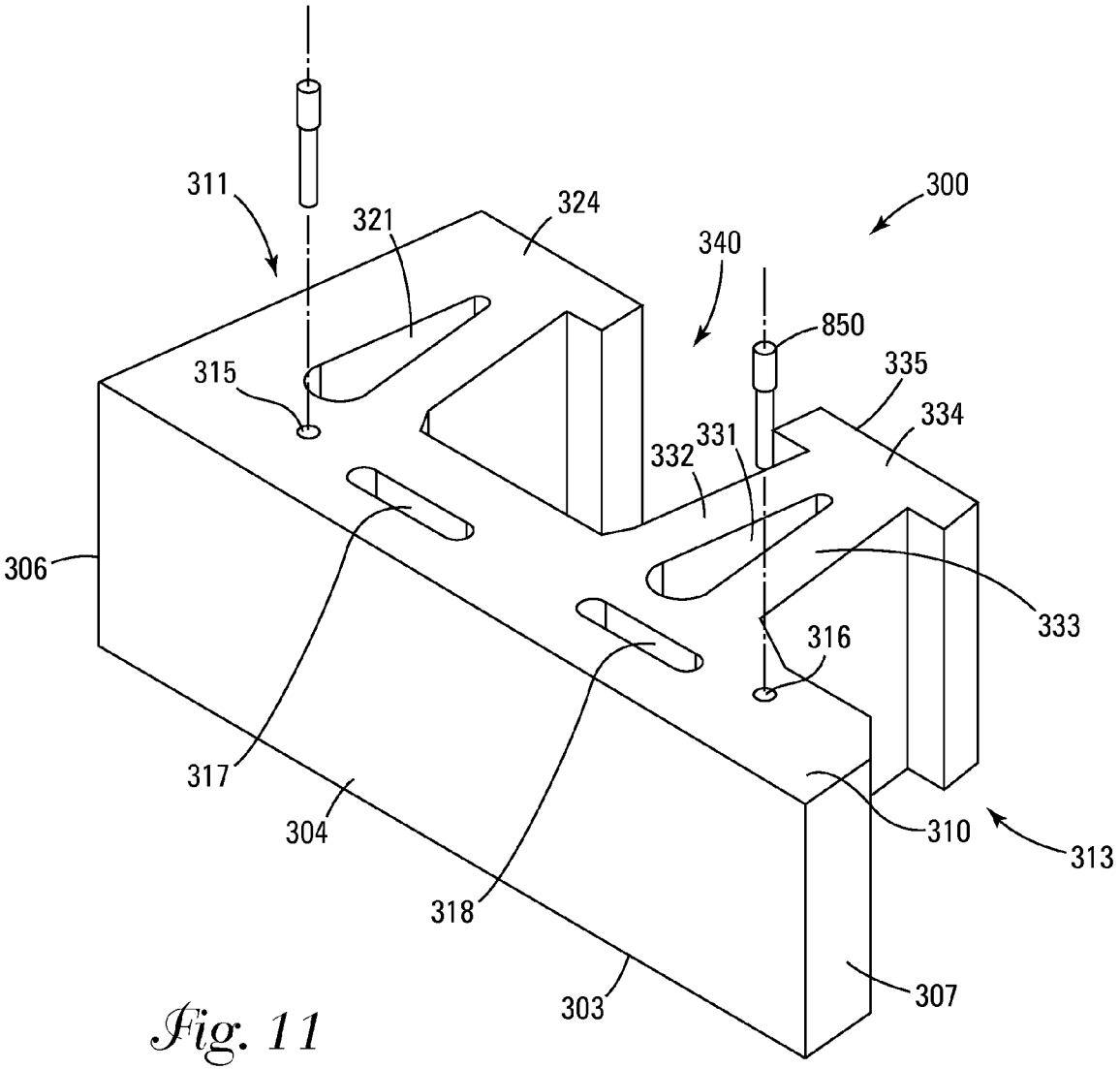
FIG. 11 is a perspective view of another block of this invention.
Figure 12:
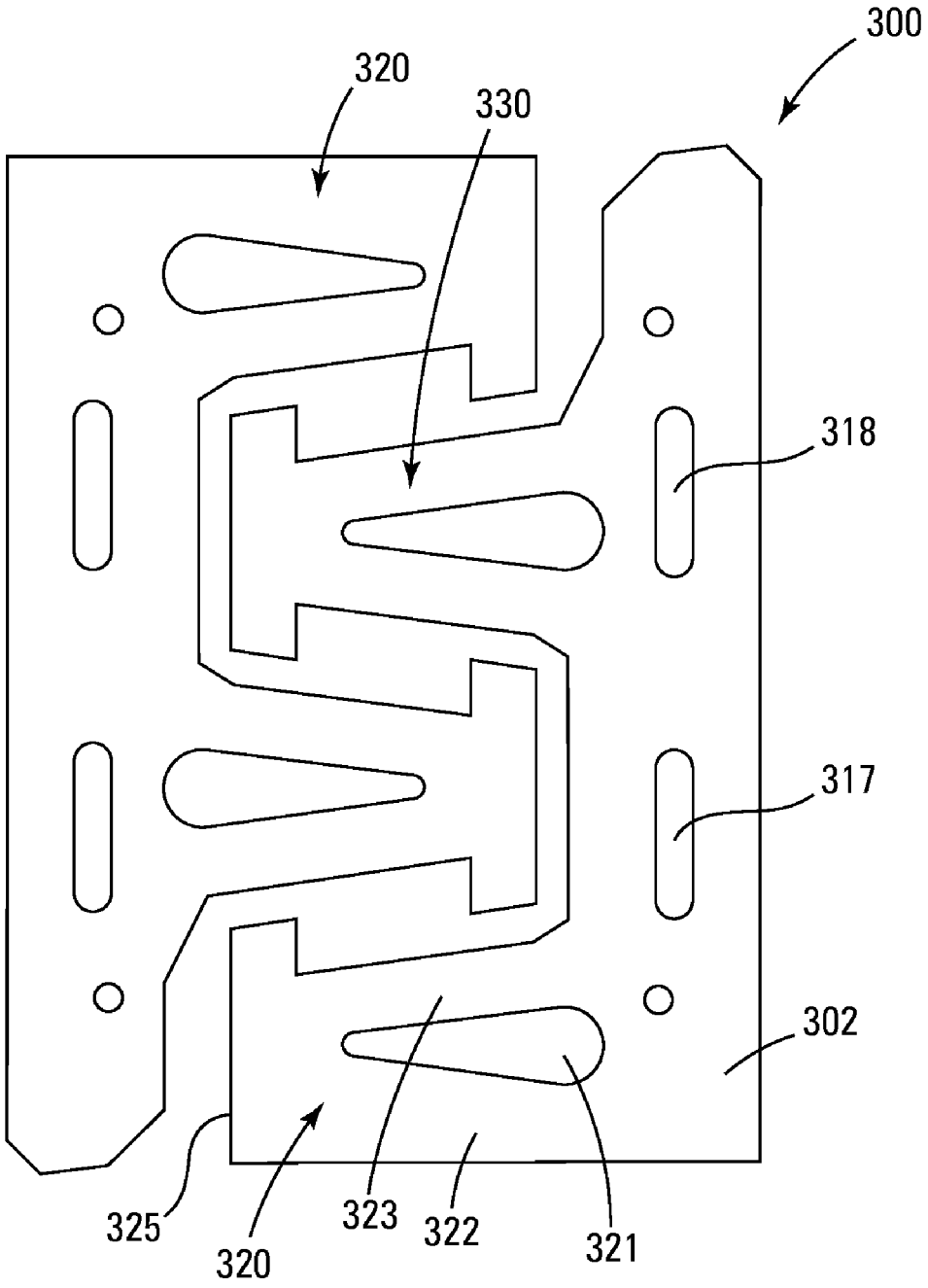
FIG. 12 is a top view of a mating pair of the blocks of FIG. 11.
Figure 13A:
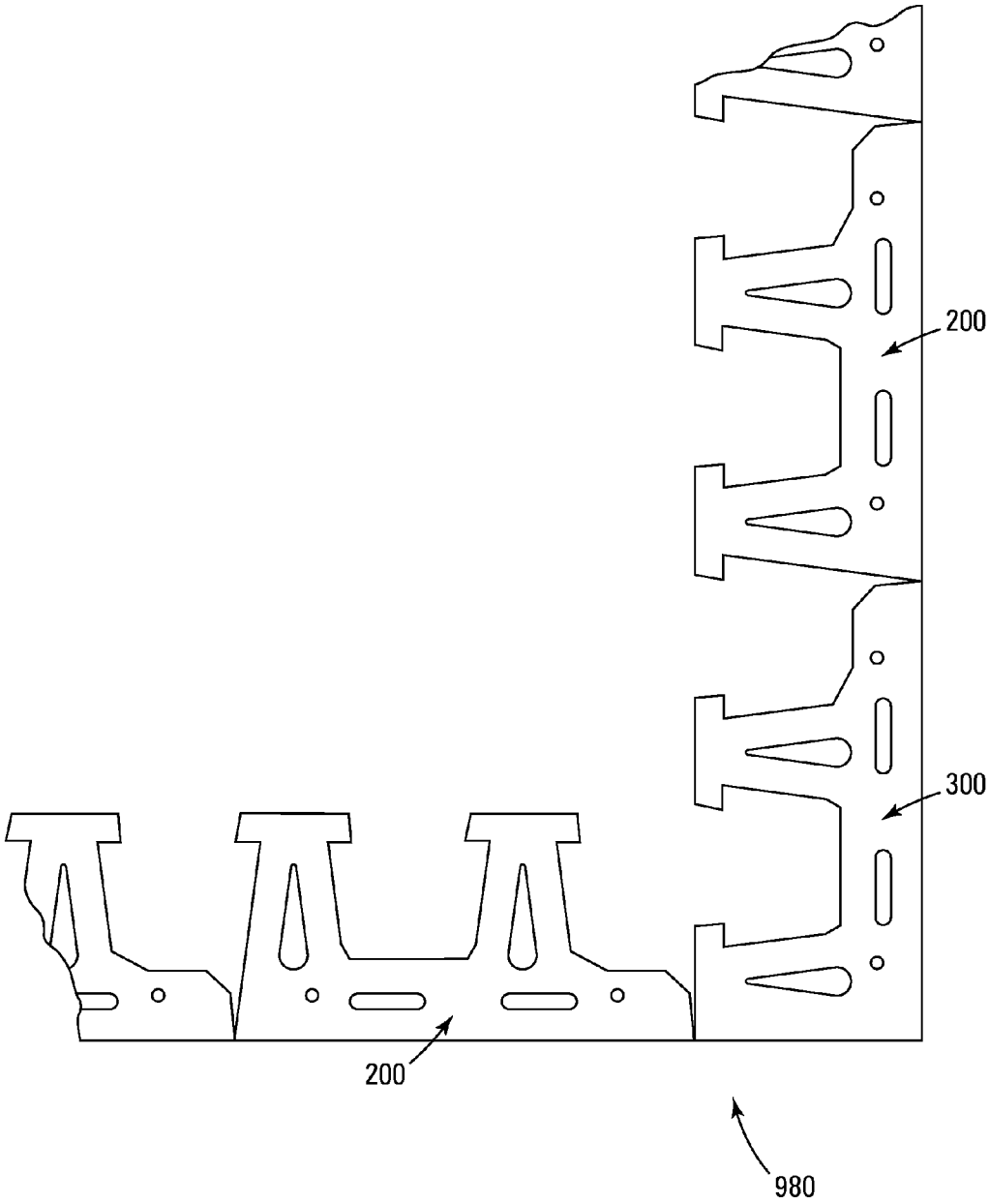
FIGS. 13A and 13B are partial top views of a row of blocks comprising the blocks of FIGS. 9 and 11.
Figure 13B:
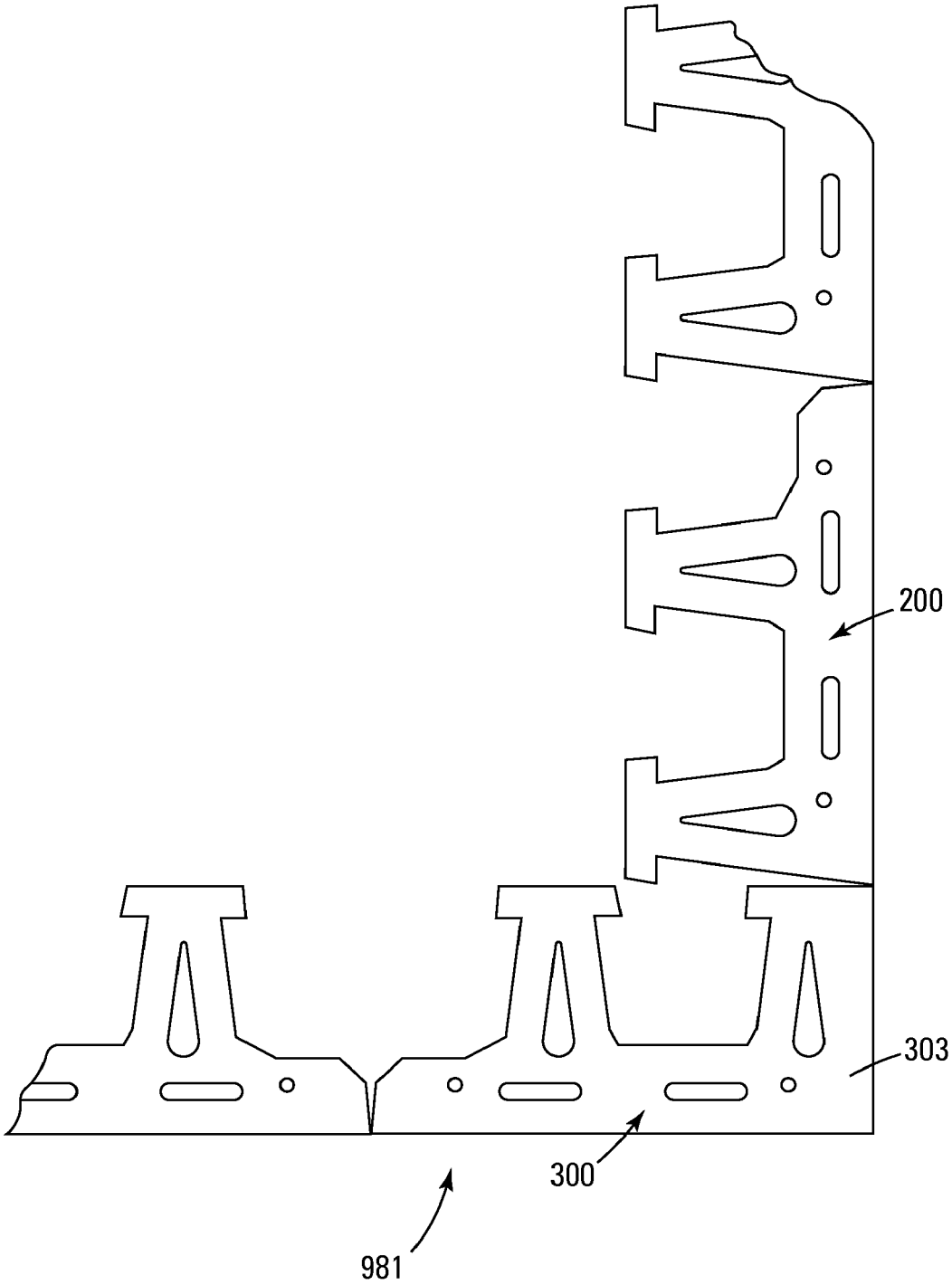
Figure 14:
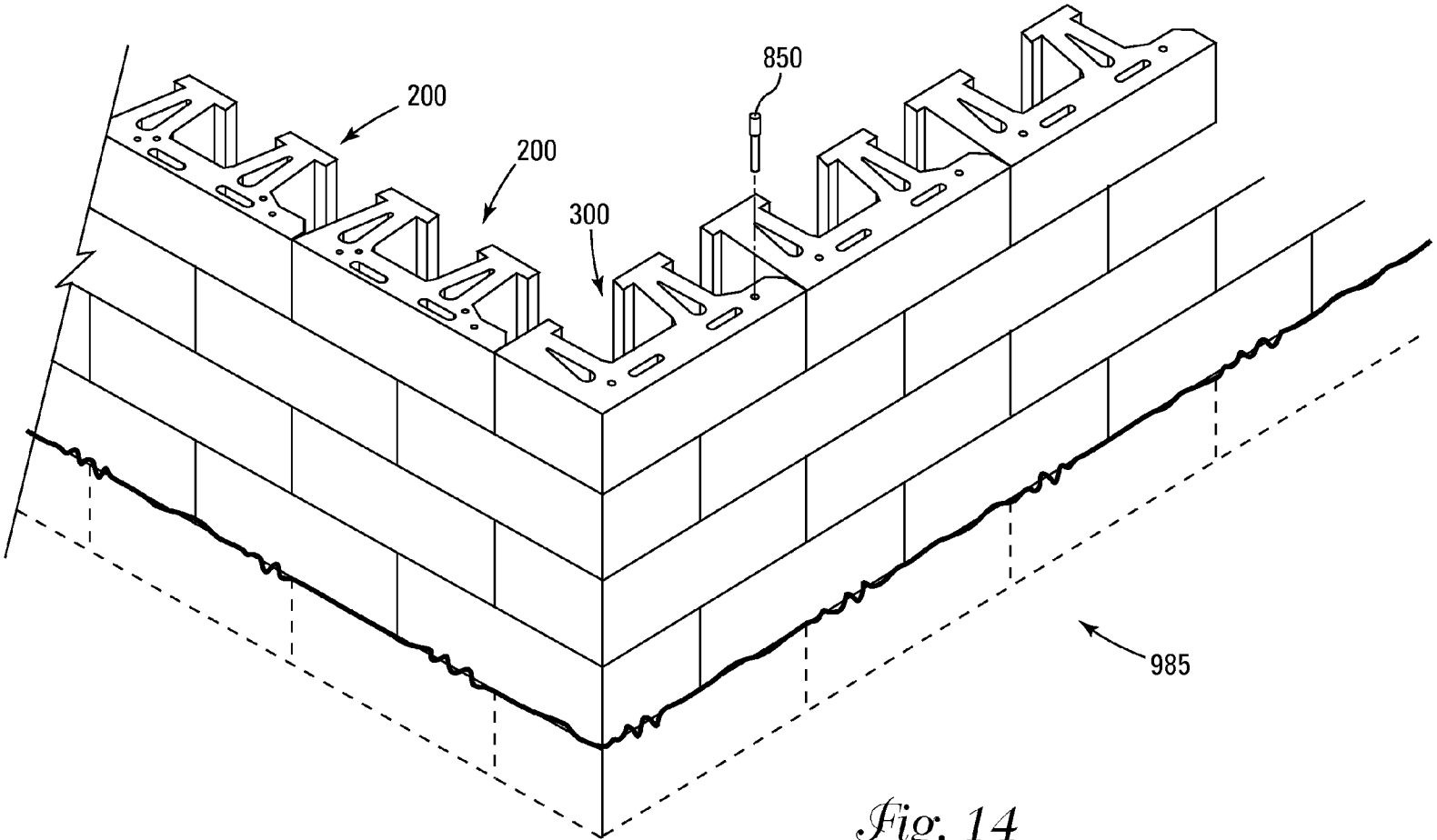
FIG. 14 is a partial view of a wall of blocks constructed with the blocks of FIGS. 9 and 11.

FIGS. 11 and 12 illustrate another embodiment of the block of this invention and FIG. 12 shows how the blocks form a mating pair. FIGS. 13A, 13B and 14 show block 300 along with block 200 in a course of blocks and in a wall. Block 300 is similar to block 200, but one of the legs forms right angles at the front and the back of the block. Since there are no chamfers on the front of the block, the block can be used in any orientation, i.e., the bottom and top surfaces are interchangeable.

Block 300 has parallel top face 302 and bottom face 303. Face 304 extends between corners 306 and 307. Extending from front portion 310 are two legs 320 and 330. Cores 321 and 331 are located primarily in the legs, though they extend into front portion 310. Legs 320 and 330 extend to rear portions 324 and 334, respectively, having rear faces 325 and 335, respectively. Front face 304 and rear faces 325 and 335 each extend from top face 302 to bottom face 303. The distance between faces 302 and 303 defines the thickness of the block.

Legs 320 and 330 are separated by void 340. Each leg 320 and 330 has two side walls 322, 323 and 332, 333, respectively. Leg side wall 322 joins front portion 310 and back portion 324 at right angles. Therefore, side 311 is perpendicular to the front face 304 and back face 325. Side 313 is substantially similar to side 213 in block 200. Side walls 332 and 333 generally converging from the front to the back of the block. The side walls extend from top face 302 to bottom face 303. Pin holes 315 and 316 and pin receiving cavities 317 and 318 are located on the front portion of the block.

FIGS. 13A and 13B show blocks 200 and 300 in a course of blocks for the construction of a wall. FIG. 13A shows course 980, in which block 300 is used as the corner block in the orientation as shown in FIGS. 11 and 12. Block 300 is flipped over in FIG. 13B, which shows course 981. During construction of a wall, courses 980 and 981 would be adjacent so that the wall would have an offset or running bond pattern.

FIG. 14 shows wall 985 formed from these two types of blocks.

Figure 15A:
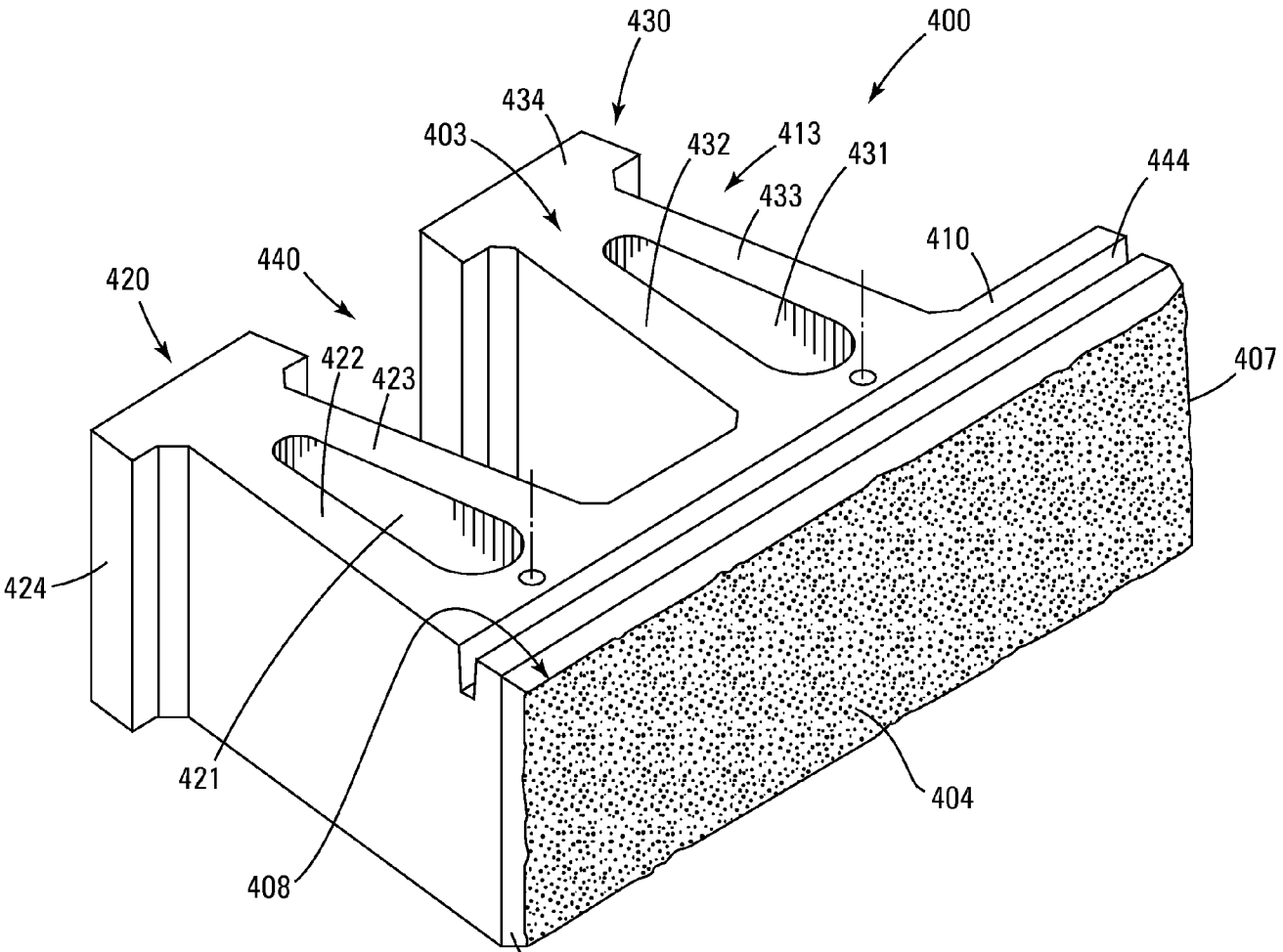
FIG. 15A is a bottom perspective view of another block of this invention.
Figure 15B:
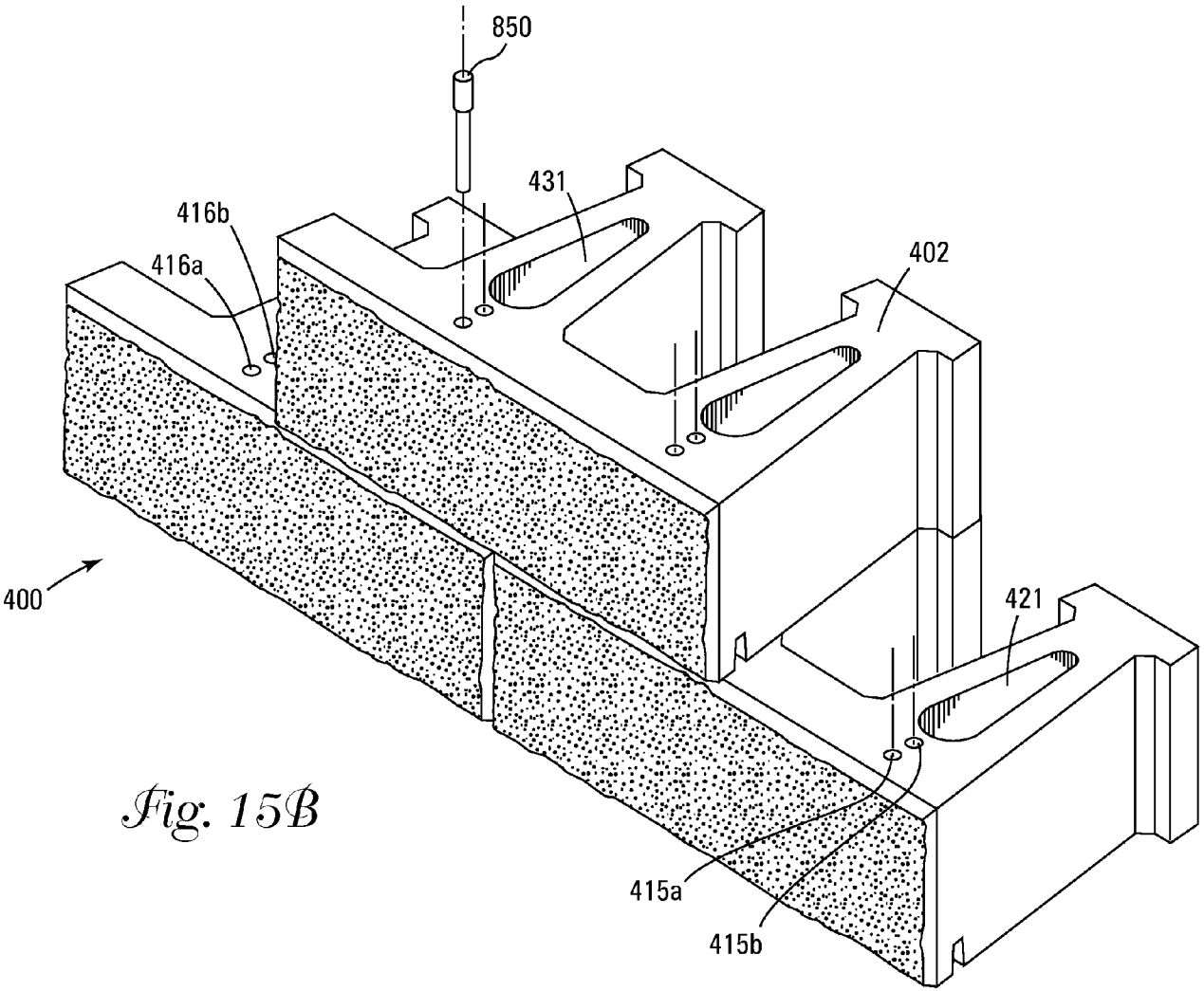
FIG. 15B a top perspective view of stacked blocks of FIG. 15A.
Figure 16:
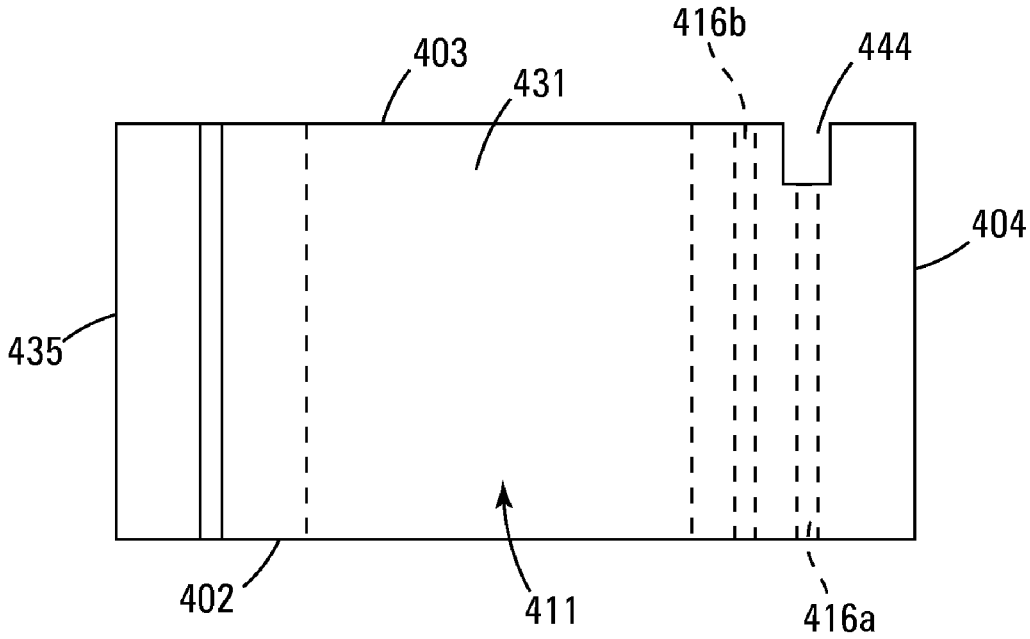
FIG. 16 is a side view of the block of FIG. 15A.

FIGS. 15A and 15B show another block embodiment, in which pin receiving cavities are absent and the front portion of the block is provided with a channel. FIGS. 15A and 15B illustrate the bottom and top perspective views of block 400. In FIG. 15A, the block is shown in the orientation as it is manufactured, that is, with the bottom surface facing up, and FIG. 16 shows a side view of the block, with pin holes and core shown in phantom. FIG. 15B shows the block stacked together with other blocks.

Block 400 has parallel top face 402 and bottom face 403. Front face 404 extends between chamfered corners 406 and 407 and has chamfered top edge 408. Extending from front portion 410 are two legs 420 and 430. Cores 421 and 431 are located primarily in the legs, though they extend into front portion 410. Legs 420 and 430 extend to rear portions 424 and 434, respectively, having rear faces 425 and 435, respectively. Front face 404 and rear faces 425 and 435 each extend from top face 402 to bottom face 403. The distance between faces 402 and 403 defines the thickness of the block.

Legs 420 and 430 are separated by void 440. Each leg 420 and 430 has two side walls 422, 423 and 432, 433, respectively, generally converging to the back surfaces. Side 411 comprises the side surface of side wall 422 and the side of front portion 410. Similarly, side 413 comprises the side surface of side wall 433 and the side of front portion 410 and has a complex geometry. Side walls 432 and 433 generally converge from the front to the back of the block. The side walls extend from top face 402 to bottom face 403.

FIG. 15B shows the top perspective view of block 400, illustrating that there are two pin holes. Pin holes 415*a*, 415*b*, 416*a* and 416*b* are located on the front portion of the block. A set of pinholes (e.g., 415*a* and 415*b*) are aligned in a plane generally perpendicular to the front face of block 400; this same plane passes through the core (e.g., core 421). It is to be noted, however, that the pin hole position may be varied as desired. Channel 444 spans the length of the block on the bottom surface near the front face. Channel 444 is configured to receive the head of a pin extending from a pin hole in a block underneath. FIG. 15B also illustrates that back portion 424 rests on back portion 434 of an underlying block. This coincidence of back portions adds to the stability of a wall.

FIG. 16 shows pin holes in phantom and illustrates that pin holes 416*a* and 416*b* extend from the top to the bottom of the block with substantially the same diameter, though it is to be noted that passageways through a block thickness typically taper from the bottom to the top in the block (as-manufactured), for ease of removal of mold elements. FIG. 16 also shows pin hole 416*a* opens into channel 444. This type of pin hole is used with shouldered pins, to that the head of the pin lies within the channel.

Figure 17:
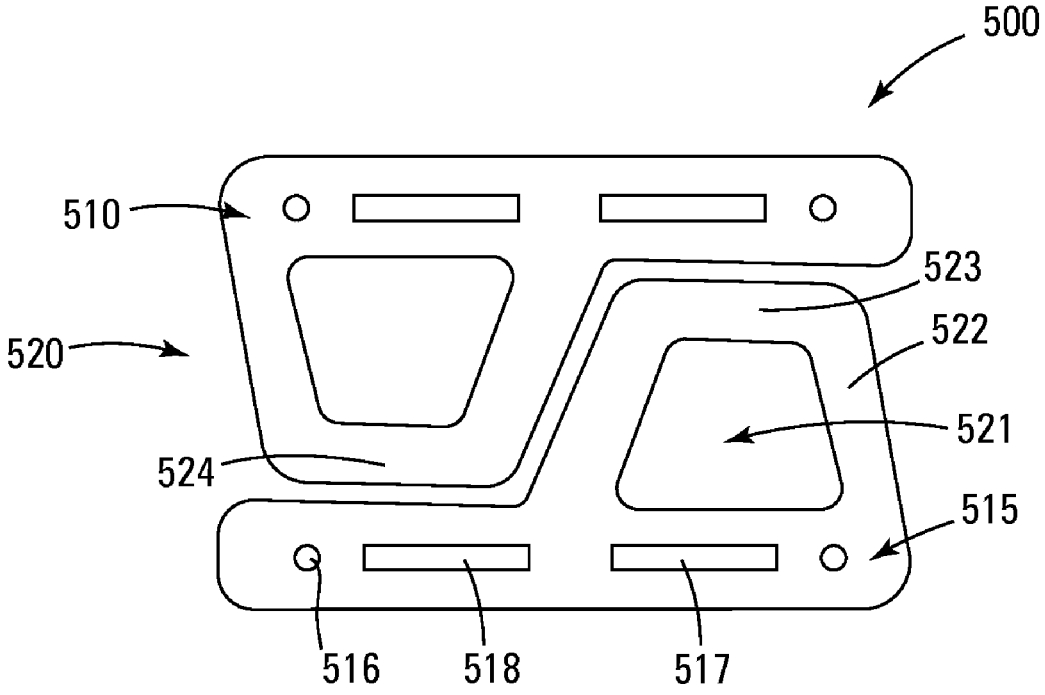
FIG. 17 is a top view of another block of this invention.

Another embodiment of the block of this invention is shown in FIG. 17. The block is similar to the block embodiments described above and has correspondingly similar elements, and not every element is numbered for this block. Block 500 has one leg 520 extending from front portion 510 to back portion 524. Leg 520 comprises two side walls 522 and 523, which join together with the front and back portions to form core 521. The core is optional but preferred because it results in a lower weight block.

Pin holes 515 and 516 and pin receiving cavities 517 and 518 are located near the front face of the block. FIG. 17 demonstrates that a pair of blocks can be formed in the mold such that mold space is maximized. Convenient dimensions for block 500 are those in which the front face is about 24 inches (60.1 cm) wide and 8 inches (20.3 cm) high. The depth of the front portion is about 4 inches (10.1 cm), and the depth of leg 520 is about 8 inches (20.3 cm).

Figure 18:
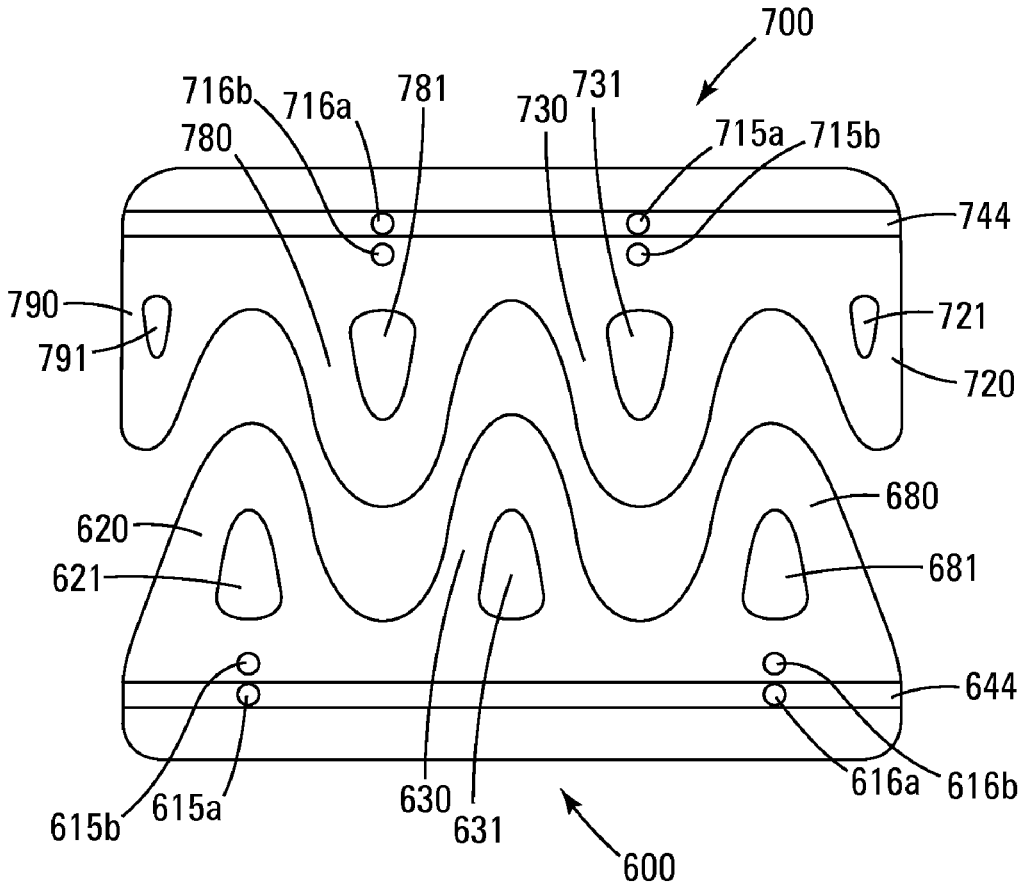
FIG. 18 is a top view of two other blocks of this invention.

Blocks 600 and 700 are shown as a mating pair in FIG. 18 and for clarity are shown moved apart from their position in a mold box. The formation of a mating pair results in one block having three legs (620, 630, 680) and the other having four legs (720, 730, 780, 790). Each leg has a core (621, 631, 681 and 721, 731, 781, and 791 respectively). Block 600 is provided with pin holes (615*a*/615*b*, 616*a*/616*b*) and channel 644 that extends the length of the block on its bottom surface. Similarly, block 700 is provided with pin holes (715*a*/715*b*, 716*a*/716*b*) and channel 744 that extends the length of the block on its bottom surface. The legs have a curvilinear shape. The legs of block 600 extend from the front portion in equally spaced intervals, essentially dividing the block into thirds.

FIG. 18 illustrates that blocks having this curvilinear shape can be formed in a matching pair, thus maximizing the mold space and minimizing the amount of material needed for each block.

Figure 19A:
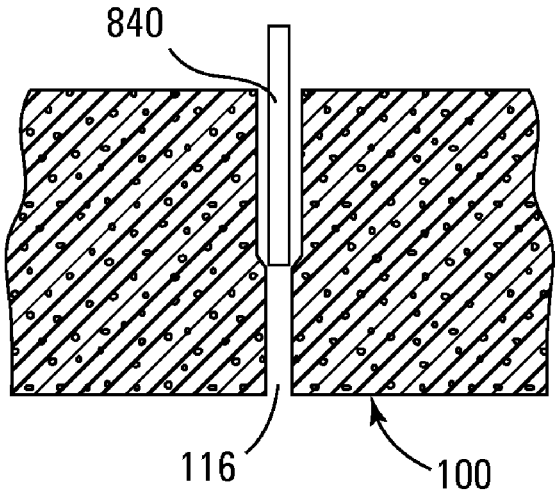
FIGS. 19A and 19B are partial cross sectional views of a block showing pin placement in a pin hole.
Figure 19B:
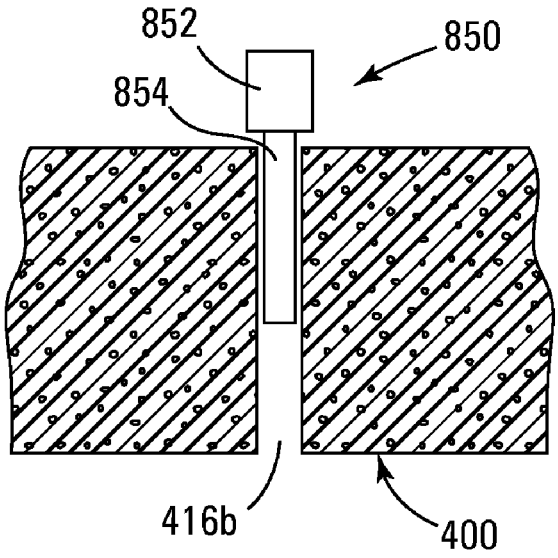

Regardless of the block embodiment, various pin configurations can be used, and two are shown in FIGS. 19A and 19B. If it is desirable to use a straight pin, the pin hole should be tapered or truncated so that the pin will not slide to the bottom of the block. Thus, as shown in FIG. 19A, pin 840 is in pin hole 116 of block 100. The pin hole is provided with a taper about half way through the thickness of the block.

FIG. 19B shows pin 850 having head 852 attached to straight portion 854. Head 852 rests on the top surface of block 400. Pin hole 416*b* has substantially the same diameter throughout the thickness of the block.

Figure 20A:
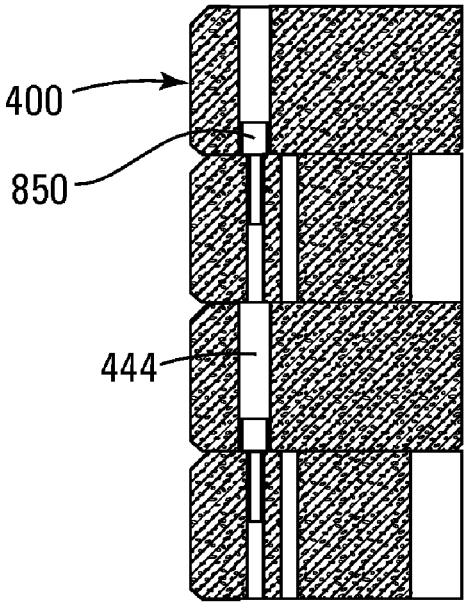
FIGS. 20A and 20B are cross sectional views of walls constructed from the blocks of this invention.
Figure 20B:
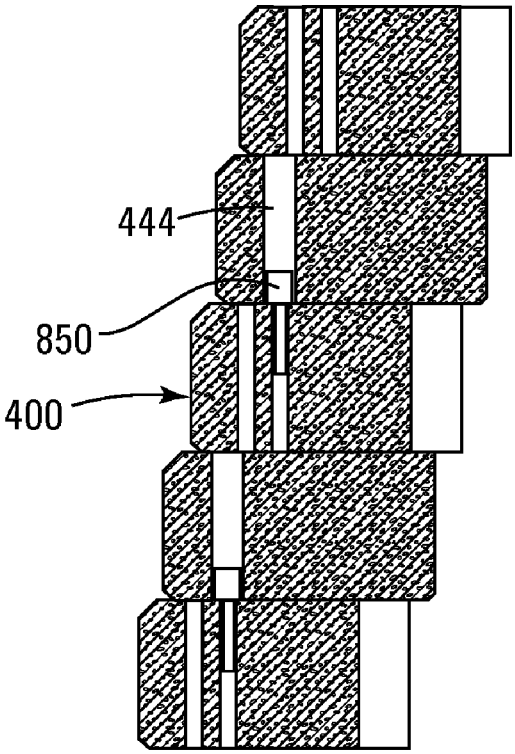

FIG. 20A shows a cross sectional view of a wall wherein blocks are stacked on top of each other, interlocked by pins 850, which are placed in forward pin hole 815. Head 852 fits within a channel (e.g., channel 444 in block 400) on the bottom surface of a block above. This arrangement produces a substantially vertical wall. FIG. 20B illustrates a wall in which blocks are set back from each other by placing pin 850 in the rearward pin hole of an underlying block. A wall having positive set back is frequently desirable because of both appearance and structural stability.

Figure 21:
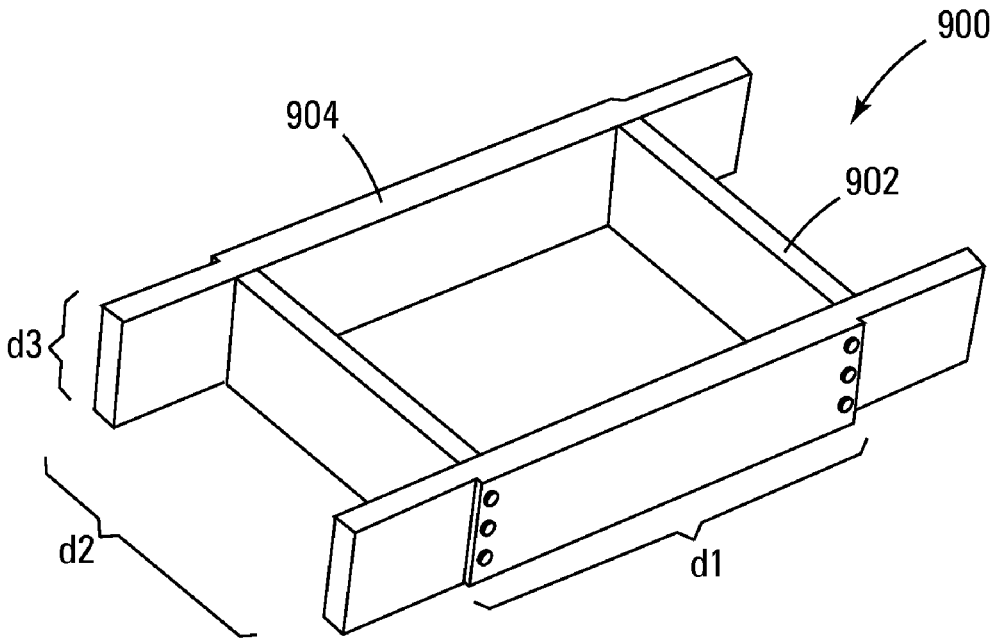
FIG. 21 is a perspective view of a mold box used to form the blocks of this invention.
Figure 22A:
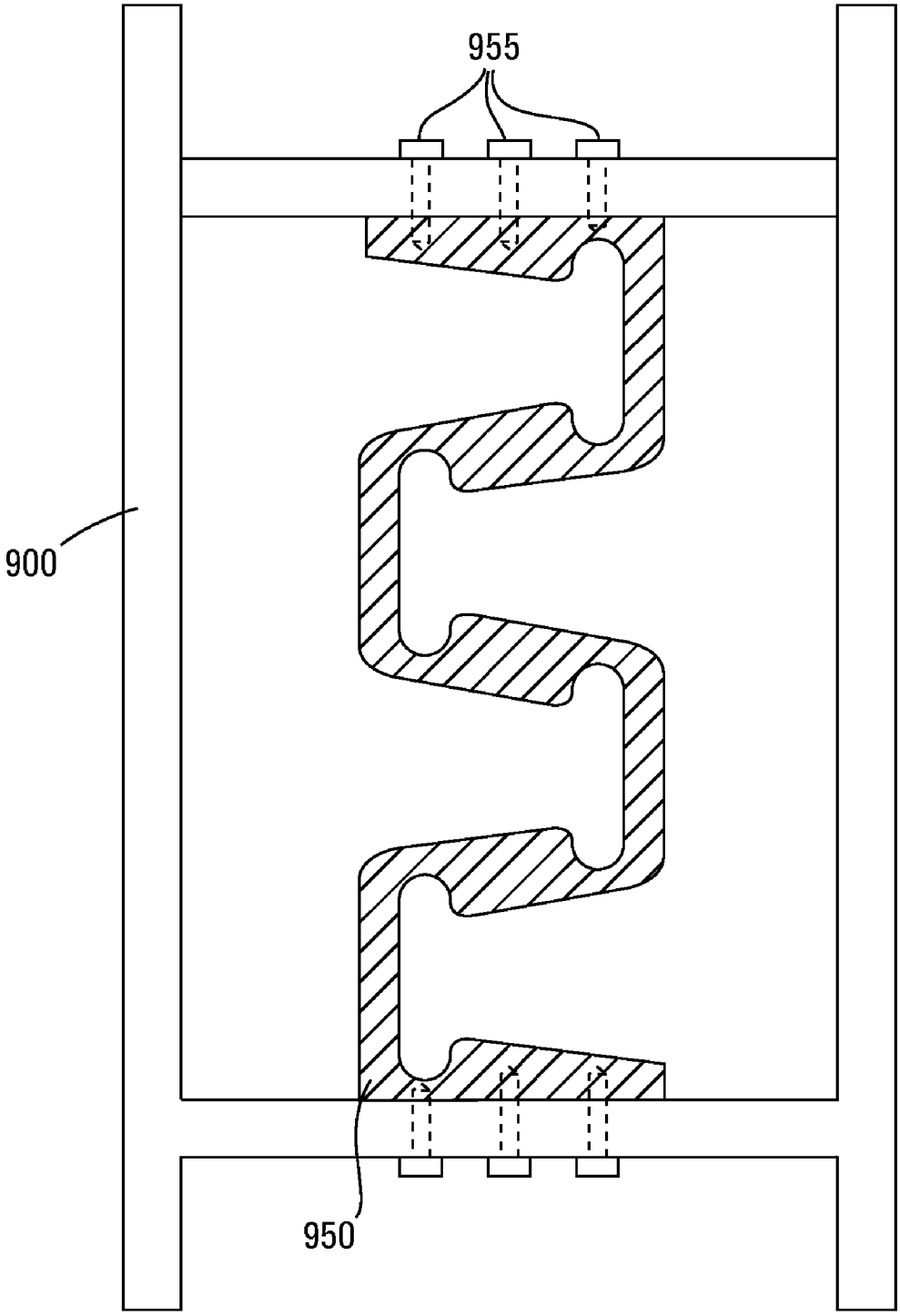
FIG. 22A is a plan view of the mold box of FIG. 21 showing the divider plate and FIG. 22B is a plan view of the divider plate with the mold box and the blocks in phantom.
Figure 22B:
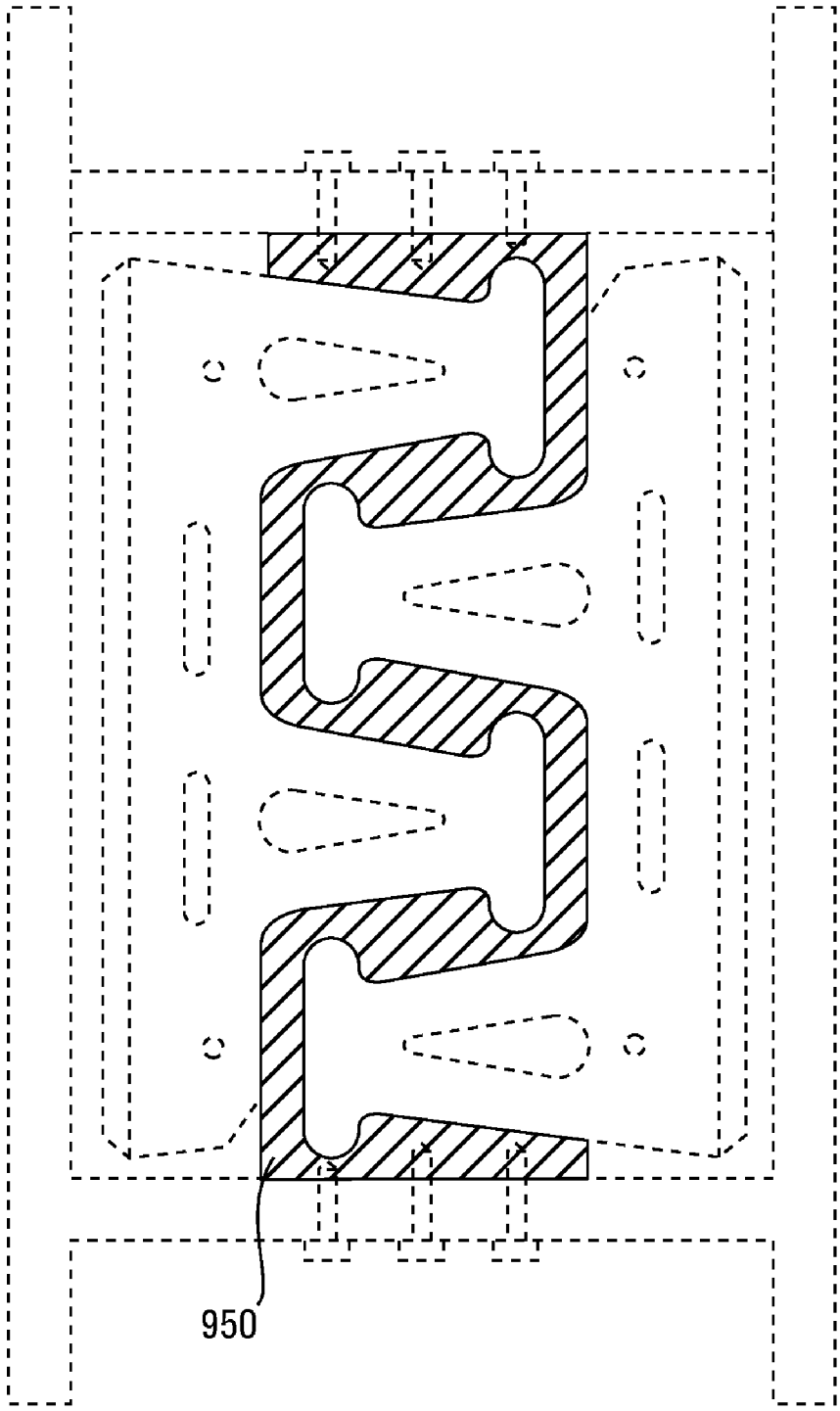

FIGS. 21, 22A, and 22B illustrate mold box 900, having first and second opposing end rails 902 and first and second opposing side rails 904. The first and second end rails are spaced apart a distance d1 and the first and second side rails are spaced apart a distance d2. Distance d2 is less than distance d1. A third distance, d3, is the height of the mold box and defines the thickness of the block. The mold box sits on a bottom plate (not shown). The bottom plate, end rails and side rails together form a cavity in which blocks are molded. In order to form the blocks of this invention, the mold box is prepared by installing divider plate 950. The divider plate thus forms first and second mold sections in the mold cavity. This plate preferably is machined from steel into the desired shape and dimensions and is bolted at either end to each side rail. FIG. 22A shows the divider plate bolted into mold box 900 with bolts 955. FIG. 22B shows the divider plate with the bolts, the mold box, and the blocks shown in phantom.

Forming elements (not shown) for the cores, pin holes, and pin receiving cavities are hung over the mold box, and a concrete mix is poured into the mold box. The box is vibrated to compact the concrete mix, which solidifies it. The blocks can then be pressed out of the mold box, and away from the divider plate and forming elements, by a stripping shoe or head that presses on the block as the bottom plate moves away. The stripping shoe is designed to pass over all the forming elements and the divider plate to facilitate removal of the block. The block, on the bottom plate, is then moved, typically by a conveyor belt, to an oven, where it is heat cured.

Typically, the blocks are shipped in the same orientation in which they are manufactured. This is desirable because each handling step increases the cost of the block. This results in another desirable feature of the present invention. Since the blocks are manufactured in an overlapping configuration they form a compact and efficient package which is easy to handle and requires less space for shipping.

The front surface of the block may be provided with a desired appearance or pattern by treating the surface as it is removed from the mold, just after it has been removed from the mold, or after curing. The surface appearance can be made to be smooth, corduroy, molded, fluted, ribbed, sand blasted, or fractured, as is known to one of skill in the art. Chamfers or other edge detail can be included in this molding process, as desired, or a block can be treated after curing to round the edges, by methods known to those of skill in the art. A fractured or split appearance is desirable because the surface then has the appearance of natural stone. Mechanical means can be used to treat the surface of a block after it has been cured and such is very effective in producing the appearance of natural stone. Such means are described in commonly assigned, co-pending application U.S. Application Publication No. 2003-0214069 (Ser. No. 10/150,484, filed May 17, 2002), hereby incorporated herein by reference.

Though the blocks illustrated in the Figures may have any desired dimension, block 100, for example (as in FIGS. 3 to 8) typically has a thickness (i.e., the distance between surfaces 102 and 103) of about 8 inches (20.3 cm) and a length (i.e., the distance from corner 20*a* to corner 21*a*) of about 24 inches (60.1 cm). The length is determined by distance d1 of the mold box.

For those blocks described above having a length of about 24 inches (60.1 cm), a depth (i.e., from the front surface to a back surface) of about 12 inches (30.5 cm), and a thickness of about 8 inches (20.3 cm), the weight is about 95 pounds. This translates to about 60 pounds per square foot of front face surface area. This is a convenient weight to use when positioning the blocks in a retaining wall and compares favorably to the weight of Prior Art blocks in terms of handling. Thus the blocks offer an advantage over the Prior Art blocks in terms of their higher front surface area per unit weight.

The blocks of this invention are efficient to use in constructing walls because the relatively larger face size, compared to the face size of prior art blocks, results in about one third more area when building a wall.

Although particular embodiments have been disclosed herein in detail, this has been done for purposes of illustration only, and is not intended to be limiting with respect to the scope of the claims. In particular, it is contemplated that various substitutions, alterations and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall block comprising:

a front portion including opposed top and bottom surfaces, opposed side surfaces and a front surface, at least one pin hole opening onto the opposed top and bottom surfaces and at least one pin receiving cavity opening onto at least one of the opposed top and bottom surfaces, the front surface having a length equal to the distance between the side surfaces and a height equal to the distance between the top and bottom surfaces; and two legs extending from the front portion in a direction opposite the front surface and having rear surfaces, the two legs having side walls that generally converge from the front surface toward the rear surfaces of the two legs of the block, the two legs being positioned such that when a wall is formed from multiple courses of the blocks which are offset from course to course by about one half the length of the front surface the legs in each course of blocks align vertically, the length of the front surface of the block being about twice the distance from the front surface of the block to the rear surfaces of the two legs, the legs being located asymmetrically on the block, and each leg having a curvilinear back portion.

2. The block of claim 1 wherein the front surface has dimensions of 20.3 cm by 61 cm.

3. The block of claim 1 wherein the at least one pin hole of the front portion is two pin holes and the at least one pin receiving cavity of the front portion is two pin receiving cavities.

4. The block of claim 1 wherein the at least one pin receiving cavity of the front portion opens onto the bottom surface.

5. The block of claim 1 wherein the at least one pin receiving cavity of the front portion opens onto both the opposed top and bottom surfaces of the front portion.

6. The block of claim 1 wherein the two legs have opposed top and bottom surfaces and wherein each leg has a core opening onto both the opposed top and bottom surfaces.

* * * * *